US006758796B2

(12) United States Patent
Stein

(10) Patent No.: US 6,758,796 B2
(45) Date of Patent: Jul. 6, 2004

(54) EXERCISER FOR THE MUSCLES OF THE PELVIC FLOOR

(76) Inventor: Daniel S. Stein, P.O. Box 49072, St. Petersburg, FL (US) 33743

( * ) Notice: Subject to any disclaimer, the term of this patent is extended or adjusted under 35 U.S.C. 154(b) by 241 days.

(21) Appl. No.: 10/141,657

(22) Filed: May 8, 2002

(65) Prior Publication Data

US 2002/0142895 A1 Oct. 3, 2002

Related U.S. Application Data

(60) Division of application No. 09/551,471, filed on Apr. 18, 2000, now Pat. No. 6,394,939, which is a continuation-in-part of application No. 09/426,556, filed on Oct. 22, 1999, now Pat. No. 6,224,525.

(51) Int. Cl.[7] ..... A63B 21/02; A61F 2/00

(52) U.S. Cl. ..... 482/148; 482/121

(58) Field of Search ..... 482/121, 128, 482/124, 126, 148, 112–113, 10–11; 128/830, 836, 838, 884, 840, 846, 885; 604/500; 600/29–30

(56) References Cited

U.S. PATENT DOCUMENTS 1,851,865 A * 3/1932 Ptacek ..... 482/11
1,928,893 A * 10/1933 Hoard ..... 606/197
D232,779 S * 9/1974 Olson et al. ..... D24/135
4,280,696 A * 7/1981 Ramon ..... 482/11
5,755,236 A * 5/1998 Dann et al. ..... 128/885
5,865,715 A * 2/1999 Wallick ..... 482/124
6,224,525 B1 * 5/2001 Stein ..... 482/148
D446,857 S * 8/2001 Stein ..... D24/135
D447,235 S * 8/2001 Stein ..... D24/135

* cited by examiner

*Primary Examiner*—Stephen R. Crow
(74) *Attorney, Agent, or Firm*—Pettis & Van Royen, P.A.

(57) ABSTRACT

An exercise device for strengthening the muscles of the pelvis, particularly the collective group of muscles involved in human sexual response, which are also important for controlling the evacuation of the intestines and the bladder. This exercise device focuses on increasing the strength, tone and endurance of these muscles. The device comprises a longitudinally extending member that includes a blunt head portion and a compressible shaft portion. The first end of the shaft portion is juxtaposed with the head portion. The first end of the shaft portion has an outwardly extending retaining slope formed thereon, particularly when the device is received within a pelvic body cavity and the muscles of the pelvic floor are at rest. The retaining slope is engageable with the retaining edge of the adjacent pelvic floor muscle platform of that pelvic body cavity to facilitate intracorporal retention within the pelvic body cavity. The compressible shaft is actively functional in creating resistance to contraction of the pelvic floor muscle platform, thereby causing the work necessary for muscle development. The second end of the shaft portion has an outwardly extending slope formed thereon. When the device is inserted into a pelvic body cavity, this outwardly extending slope is engageable with the body tissue that is adjacent to the orifice into the pelvic body cavity to prevent over insertion of the member.

7 Claims, 24 Drawing Sheets

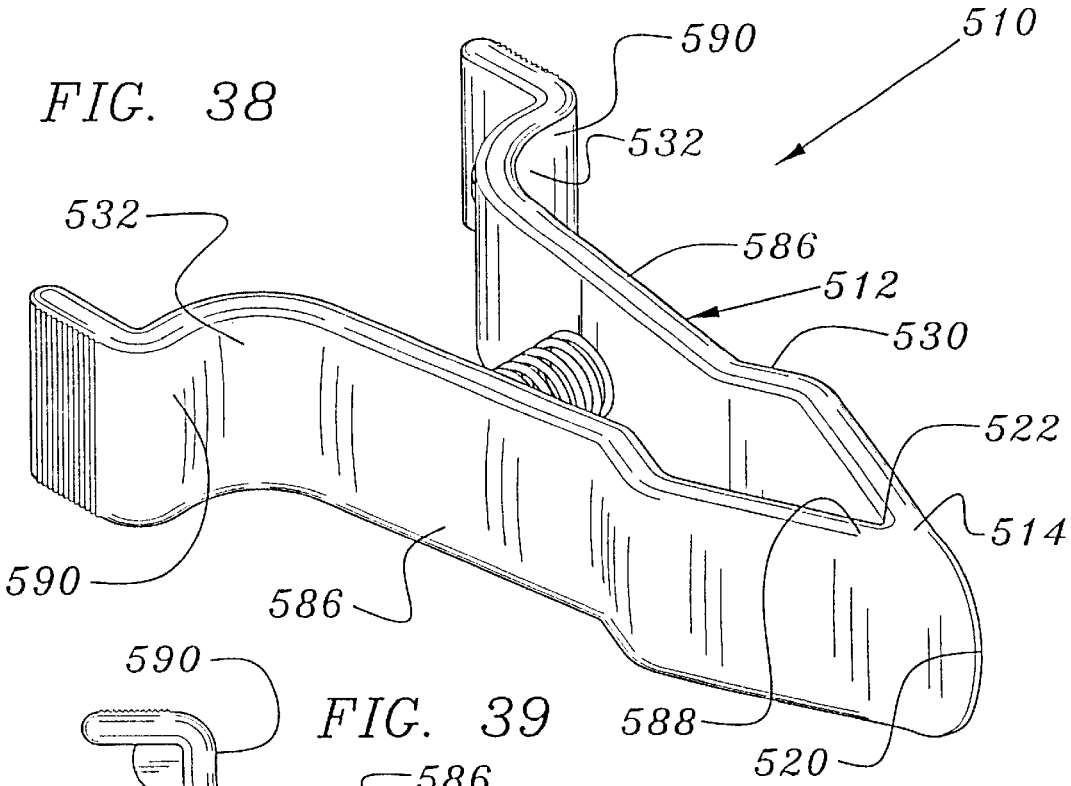
FIG. 38
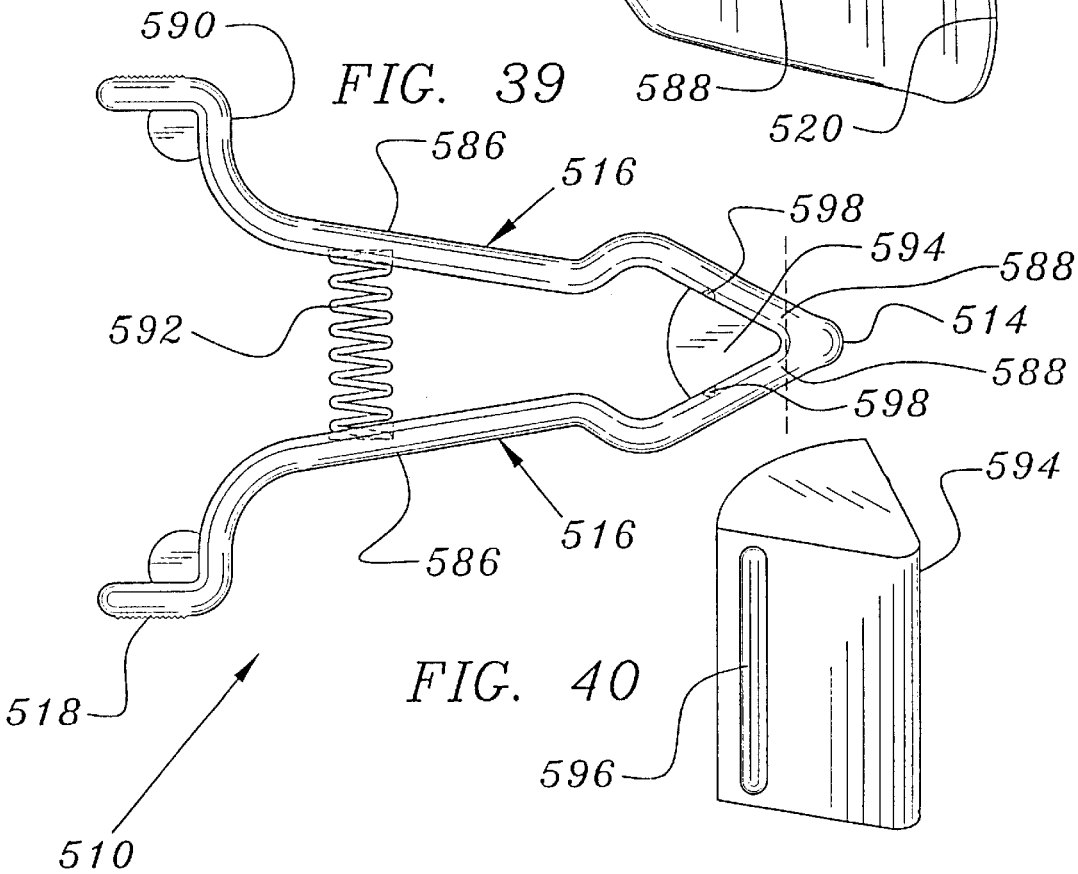
FIG. 39
FIG. 40

EXERCISER FOR THE MUSCLES OF THE PELVIC FLOOR

This application is a division of application Ser. No. 09/551,471, filed Apr. 18, 2000 now U.S. Pat. No. 6,394, 939, which is a continuation-in-part of application Ser. No. 09/426,556, filed Oct. 22, 1999 now U.S. Pat. No. 6,224, 525.

BACKGROUND OF THE INVENTION

1. Field of the Invention

The present invention relates to an exercise device for strengthening the muscles of the pelvic floor, particularly the collective group of muscles involved in human sexual response, which are also important for controlling the evacuation of the intestines and the bladder. The exercise device focuses on increasing the muscle endurance, strength and tone of these muscles.

2. Description of the Prior Art

The lower pelvic muscles may become damaged or weakened through childbirth, lack of use, age or other reasons. One of the symptoms related to a weakening of these muscles is urinary incontinence. Various exercise devices were developed in an attempt to strengthen the pelvic floor muscles, with the specific goal of strengthening the muscles that surround the urethra to overcome urinary incontinence in women. It was discovered that strengthening these muscles also increased the patient's sexual response.

Perhaps the oldest patented device is disclosed in U.S. Pat. No. 1,928,893 that was issued to Dr. Ralph D. Hoard in 1933. The device was designed to be inserted in a patient's vagina to exercise the vaginal muscles. It is comprised of a two sided tubular apparatus whose sides are held slightly apart by springs. The sides of the tubular device are squeezed shut against the pressure of the springs by the vaginal muscles.

A number of devices were invented by Dr. Arnold Kegel; some devices use a pressurized sleeve that is inserted within the vagina to exercise the muscle tissue around the vagina and to measure their strength. Another Kegel device comprises a solid elongate shaft, having a varied cross-section, which is inserted within the vagina so that the patient can squeeze the muscles of the vagina, as well as many of the other muscle groups in the lower pelvis, against the hard, unyielding device, providing isometric exercise.

Additional patents were issued for a number of other isometric exercisers, including U.S. Pat. No. 2,763,265, issued to E. G. Waters and U.S. Pat. No. 5,554,092, issued to Stanley D. Harpstead, et al. The Waters device is a generally hard tubular device that has varying cross sectional dimensions for assistance in identifying the various muscle groups and for applying isometric exercise to those muscle groups within or connected to the vagina. The Harpstead device is a hollow body designed to receive various configurations of weights. With the patient in the upright position, the device is inserted within the vagina so that the muscles of the vagina and the pelvic area must be constricted and held in a continuing contracted or squeezed state without further change in muscle length (isometric exercise) in order to hold the weighted device in the vagina above the retaining edge of the vaginal muscle platform.

Notwithstanding the existence of such prior art exercisers, it remains clear that there is a need for an exerciser that dynamically exercises the muscle groups, is simple to use, has a low risk of injury and is easy to maintain.

SUMMARY OF THE INVENTION

The present invention relates to an exerciser for the pelvic floor muscles, including the collective group of muscles involved in human sexual response. The proper conditioning of these muscles is important for maintaining good health and body function. One preferred embodiment of the device of the present invention comprises a longitudinally extending member that includes a head portion and a shaft portion. The head portion has a first end and a second end. The head portion tapers from the second end toward the first end, with the first end being generally blunt.

The first end of the shaft portion is juxtaposed with the second end of the head portion. The first end of the shaft portion has an outwardly extending retaining slope formed thereon. The retaining slope is engageable with the retaining edge of the adjacent pelvic floor muscle platform of that particular pelvic body cavity, to facilitate intracorporal retention.

A portion of the shaft is crafted to offer resistance to repetitive pelvic floor muscle contraction by being compressible. The degree of resistance to compression may be varied. It is intended to cause work, the work of pelvic muscles contracting against resistance, which stimulates the development of muscle strength, tone and endurance.

The second end of the shaft portion has an outwardly extending slope formed thereon. When the device is inserted into a pelvic body cavity, this outwardly extending slope is engageable with the body tissue that is adjacent to the orifice that opens into the pelvic body cavity to prevent over insertion of the member.

A gripper is attached to the second end of the member and is used to grasp the device with one hand so that the device may be easily removed from the pelvic body cavity. The device is sized and configured to be received within the pelvic body cavity of the human body to exercise the muscles of the pelvic floor.

The invention accordingly comprises an article of manufacturer possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 38 is an isometric view of a sixth embodiment of the invention.

FIG. 39 is a top plan view of the invention of FIG. 38.

FIG. 40 is a detailed view of the resistance body of FIG. 39.

Similar reference characters refer to similar parts throughout the several views of the drawings; however, different embodiments utilize reference numbers increased in increments of 100.

DESCRIPTION OF A PREFERRED EMBODIMENT

Figure 1:
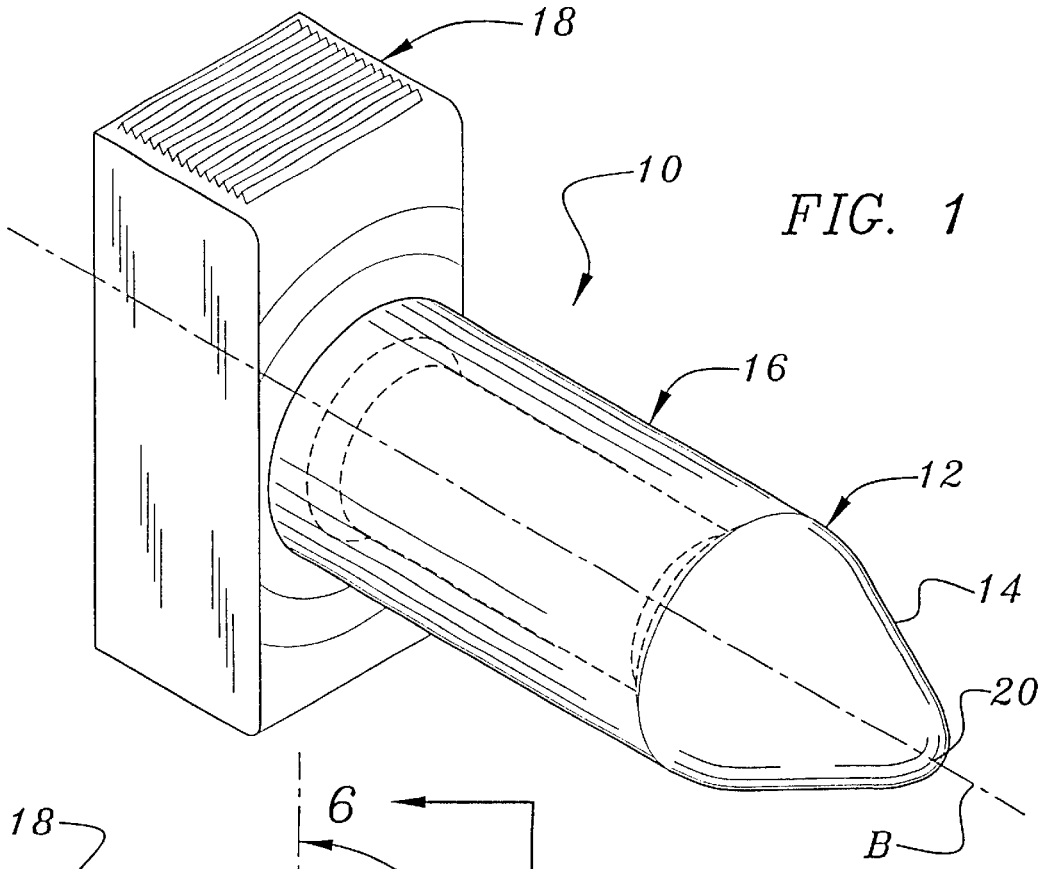
FIG. 1 is an isometric view of a preferred embodiment of the exerciser of this invention.

A preferred embodiment of the exercise device of this invention is illustrated in the drawing FIGS. 1–6, and the use of the device is illustrated in FIGS. 15–18. Additional embodiments of the invention are shown in drawing FIGS. 7–12 and 19–53. The exercise device is generally indicated as 10 throughout FIGS. 1–6 and reference characters for similar parts for additional embodiments are increased in increments of 100. Referring first to the view of FIG. 1, it can be seen that the device 10 comprises a longitudinally extending member, generally indicated as 12, that includes a head portion 14 and a shaft portion 16. The device 10 also comprises a gripper, generally indicated as 18, which is attached to the member 12.

Figure 2:
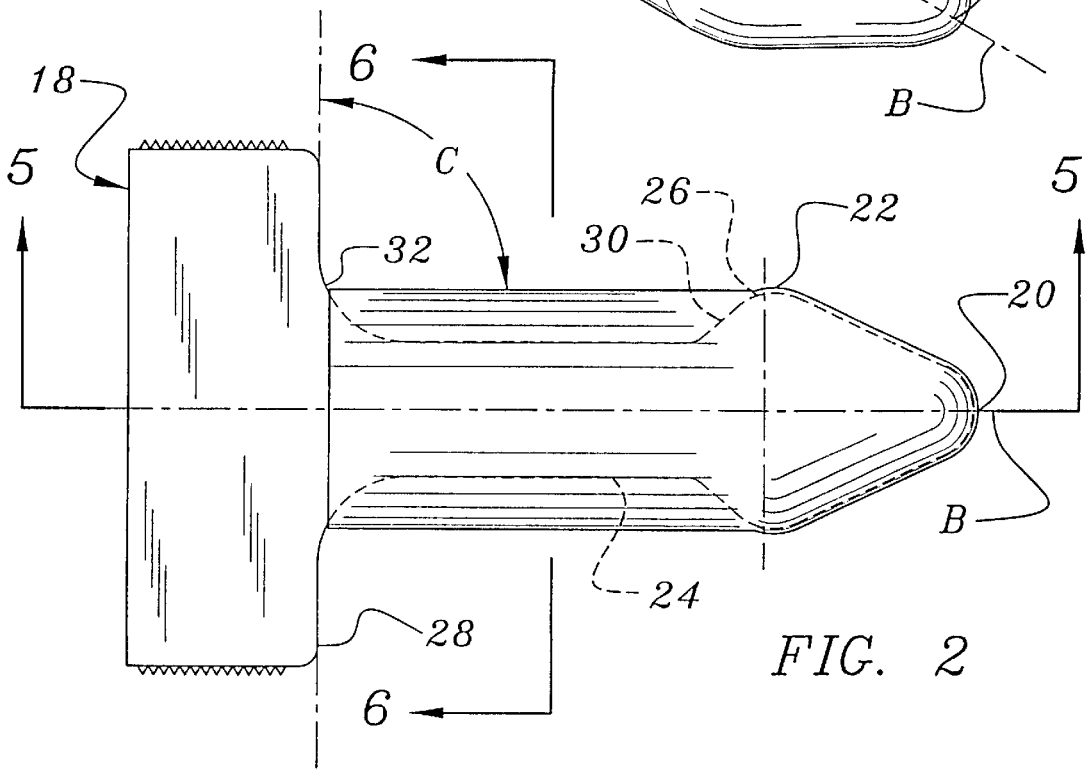
FIG. 2 is a front elevational view of the invention of FIG. 1.
Figure 5:
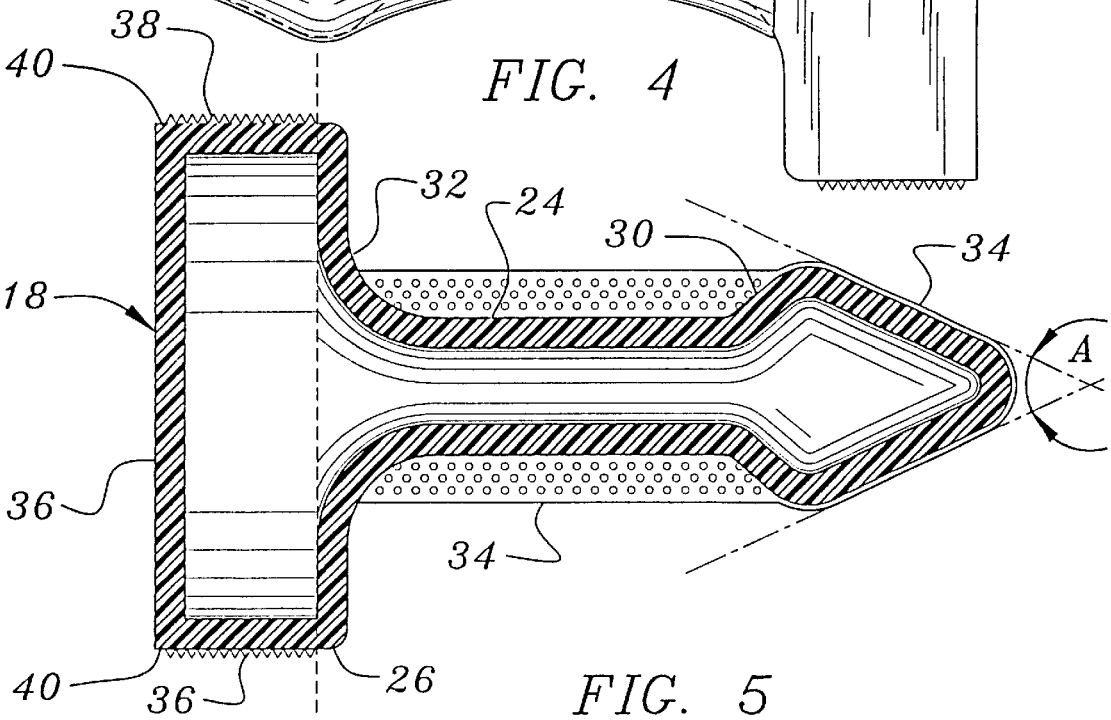
FIG. 5 is a cross-sectional view of the invention of FIG. 1, taken along the line 5—5 of FIG. 2.

As seen in FIG. 2, the head portion 14 has a first end 20 and a second end 22, the second end being juxtaposed to the shaft portion 16. The first end 20 of the head portion 14 is formed as a blunt probe like insertion tip for ease in entering the body cavities through the vaginal or anal orifices. The head portion 14 is tapered from its second end 22 to its first end 20 forming a gradual slope for comfort and ease of insertion of the member 12 of the device 10. In a preferred embodiment, the angle A, as shown in FIG. 5, is approximately 45 degrees, but the angle may be varied in other embodiments, as long as comfort and ease of use is maintained. In a preferred embodiment, the head portion 14 is made from a generally rigid material, such as a synthetic resin or other suitable materials, including but not limited to metals. In other embodiments it may be made from softer materials.

The shaft portion 16 is constructed so that at least a portion of it is compressible. In the preferred embodiment of FIG. 1, and as can be seen FIG. 5 and FIG. 2, the shaft portion 16 is comprised of a generally rigid element 24 that has a first end 26 and a second end 28. An outwardly extending retaining slope 30 is formed on the first end 26 of the rigid element 24 and an outwardly extending slope 32 is formed on the second end of the rigid element 24. The outwardly extending retaining slope 30 is engageable with the retaining edge of the adjacent pelvic floor muscle platform, when the member 12 is inserted within a pelvic body cavity and the muscles of the pelvic floor are at rest. The retaining slope 30 retains the member 12 within the pelvic body cavity when the muscles of the pelvic floor muscle platform are contracted. The outwardly extending slope 32 is engageable with the tissue adjacent to the orifice into a pelvic body cavity when the member 12 is inserted into the pelvic body cavity. This outwardly extending slope 32 is angled in relation to the longitudinal axis B, as seen in FIG. 2, sharply enough to ensure that the member 12 is prevented from totally entering the pelvic body cavity. In a preferred embodiment the angle of the outwardly extending slope 32, in relation to the shaft 16 which is parallel to the longitudinal axis B, is generally 90 degrees. A layer of compressible material 34 is attached circumferentially about the rigid element 24, providing a surface that compresses under the pressure of muscle contraction. Isometric exercise is accomplished by working the muscles against a rigid object, that is contracting muscles without a significant shortening of the muscle fibers. By having a material that gives under muscle contraction, it allows the muscles to shorten and lengthen with each contraction and relaxation. Once the material has given as far as it can, or the user is unable to apply any additional pressure, the user can continue to apply pressure isometrically. Thus the current invention, provides a means for exercising through muscular movement as well as by isometric exercise, providing increased tone and strength. The amount of distance through which the muscles may work is adjustable by adjusting the thickness of the layer of compressible material 34. In addition, the amount of resistance may be may be increased or reduced by using materials with different compressibility characteristics. In this preferred embodiment, the selected material must reduce in size and volume when under pressure, for example foam rubber. Increasing the density of the foam rubber will increasing the resistance to muscle contraction and therefore increase the level of exercise. Foam rubber is but one material that may be used as there are many others that are suitable for the purpose. Therefore the selection of material 34, the thickness of the compressible material 34 and its firmness will be adjusted by those skilled in the art to produce a device that is capable of producing the level of exercise desired, whether beginning, intermediate or advanced. The thickness of the layer of compressible material may be increased by decreasing the diameter of the rigid element. The greater the thickness of the layer of compressible material 34 the greater the lengthening and shortening of the muscle fibers during exercise.

The gripper 18 is attached to the second end 26 of the rigid element 24 of the shaft portion 16. The gripper, in this preferred embodiment, comprises a rectangular body 36 having a series of raised edges 38 formed on the short sides 40 of the body 36. The gripper body 36 may be of any suitable length, but should be wide enough to grasp easily. In other embodiments, the gripper 18 may comprise a loop, a ring or any other well-known configuration that is easy to grasp.

Figure 3:
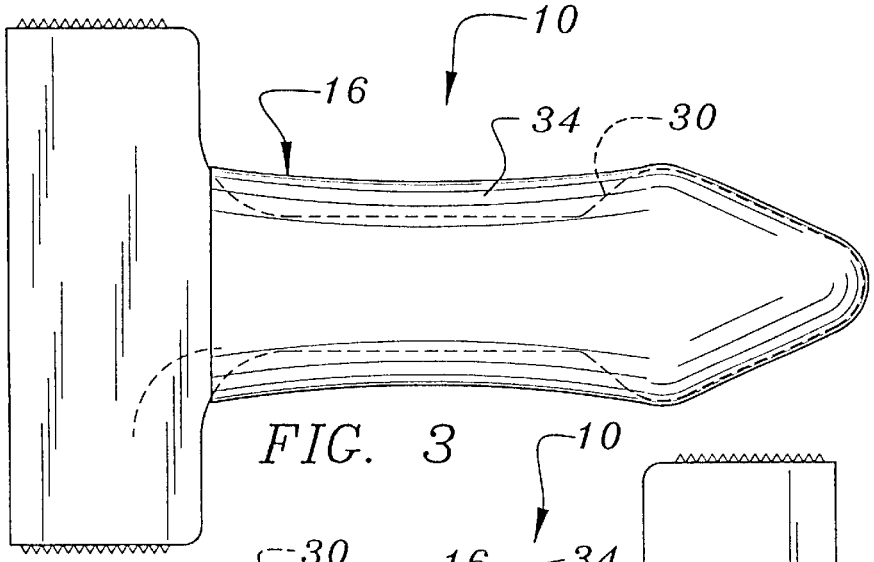
FIG. 3 is a front elevational view of the invention of FIG. 1, illustrating the partial compression of the compressible part of the shaft portion, when the device is inserted in a pelvic body cavity and the pelvic floor muscles are at rest.
Figure 4:
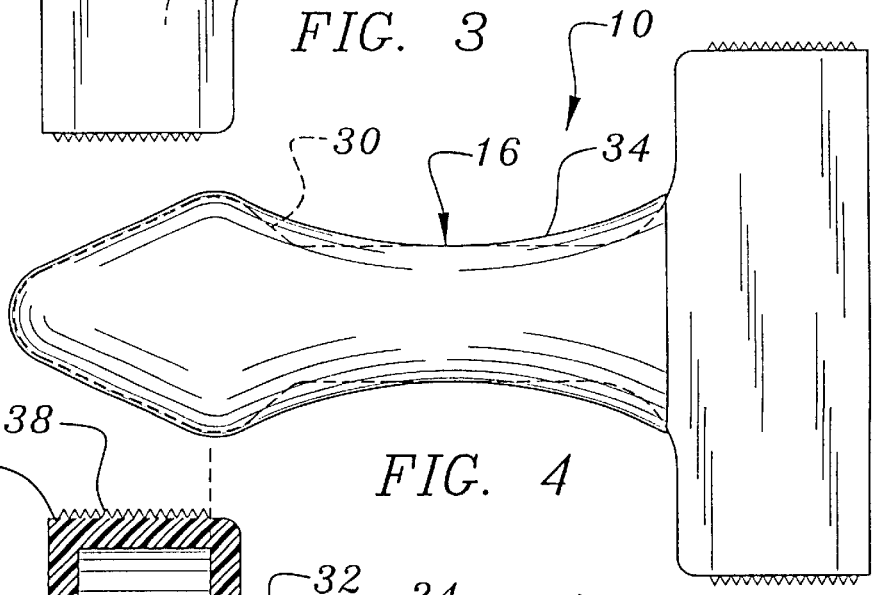
FIG. 4 is a rear elevational view of the invention of FIG. 1, illustrating full compression of the compressible portion of the shaft portion when the device is inserted in a pelvic body cavity and the pelvic floor muscles are tightened.
Figure 13:
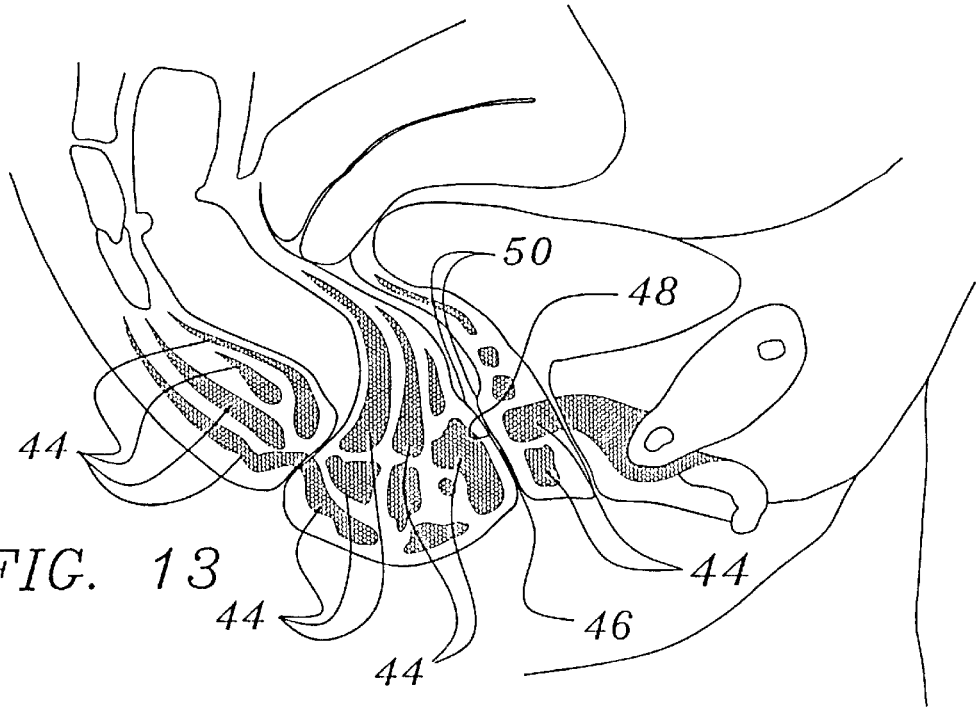
FIG. 13 is a line drawing of the pelvic portion of the female human anatomy.
Figure 14:
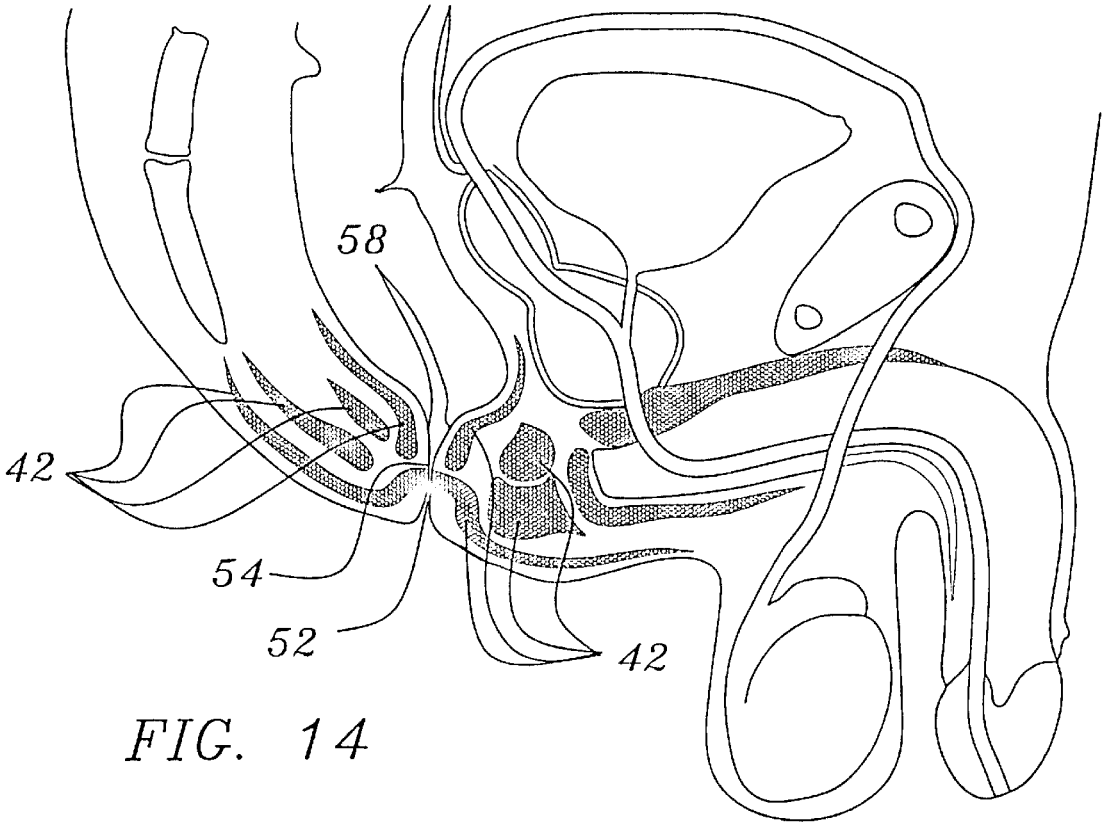
FIG. 14 is a line drawing of the pelvic portion of the male human anatomy.
Figure 15:
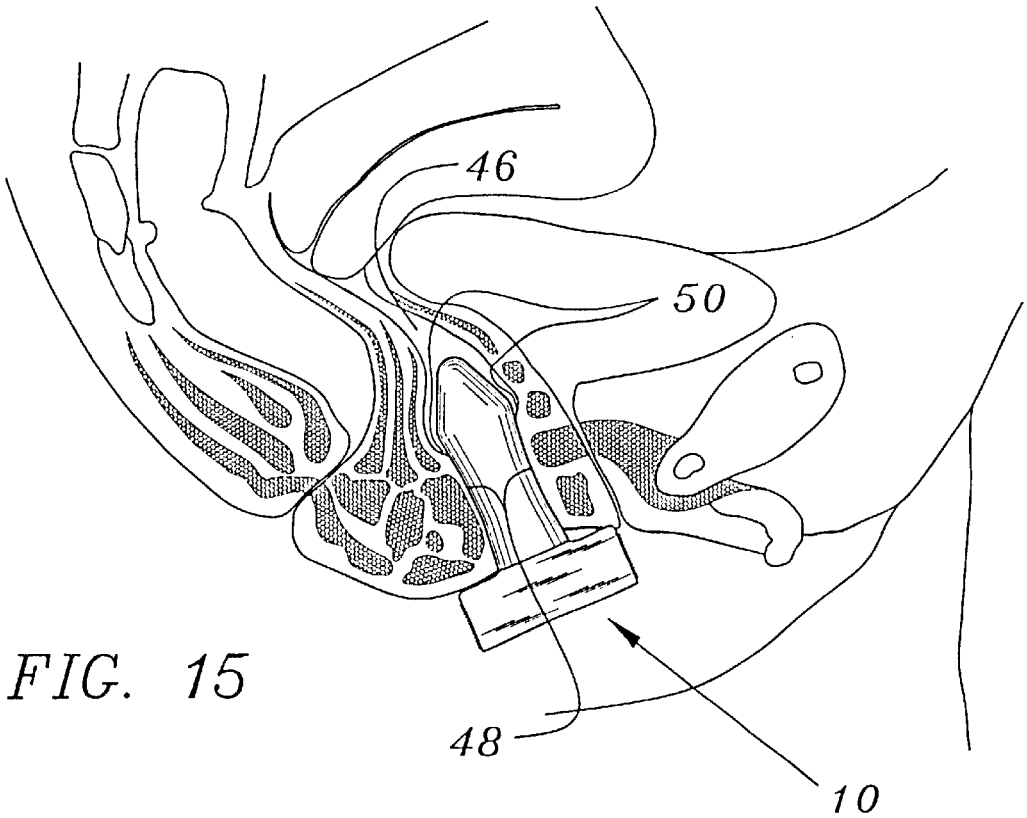
FIG. 15 is a line drawing of the pelvic portion of the female human anatomy, illustrating the position of the exerciser inserted within the vaginal cavity with the muscles of the pelvic floor at rest.
Figure 16:
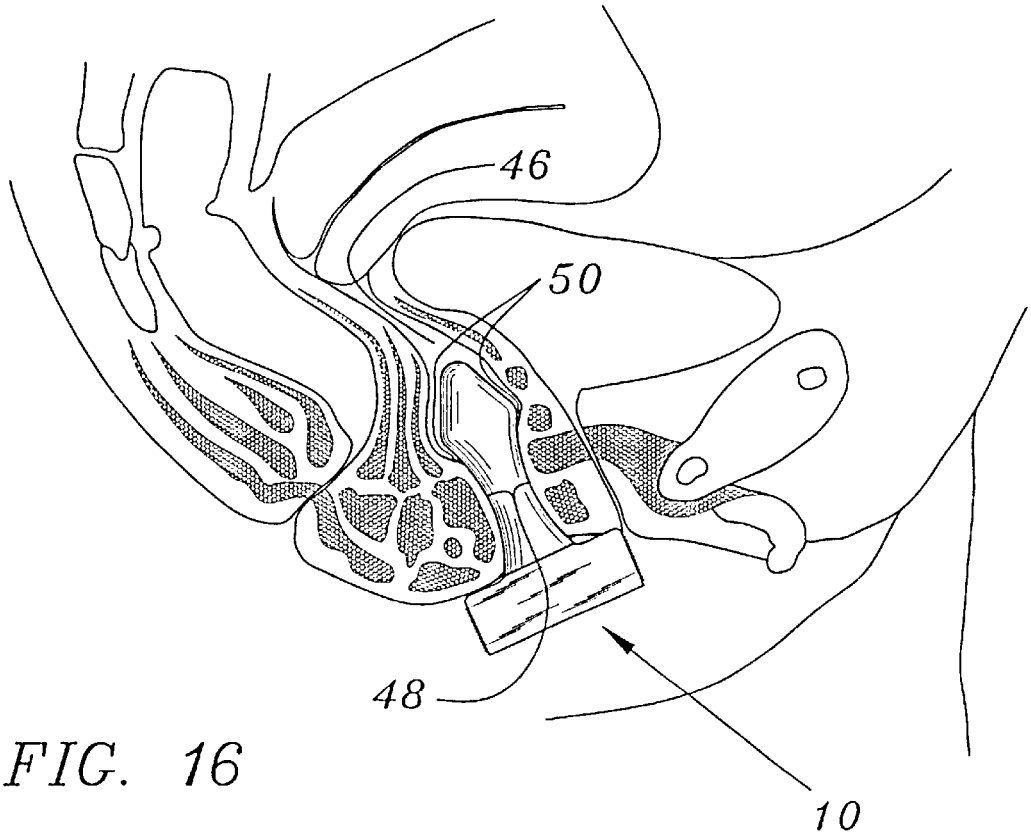
FIG. 16 is the line drawing of FIG. 15 illustrating the exerciser with the muscles of the pelvic floor contracted.

As seen in FIG. 13 and FIG. 14 the muscles of the pelvic floor are at rest with the vaginal or anal orifice being held generally closed by the resting partial contraction of the vaginal or anal pelvic floor muscles respectively, This is known as the resting tone of a muscle. In FIG. 15, the device 10 is shown inserted into a pelvic cavity, in this case the vagina 46, so that the head portion 14 extends beyond the vaginal pelvic floor muscle platform 48 and into the vagina 46. The shaft portion 16 is sized and configured to match the length of the vaginal pelvic floor muscle platform 48. When the vaginal pelvic floor muscle platform 48 closes about the device 10, the pelvic floor muscles 44 apply pressure against the shaft portion 16, even while the muscles are at rest. FIG. 3 illustrates the pressure of the pelvic floor muscles 44 on the shaft portion 16 while the muscles are at rest. As seen in FIGS. 15 and 16, the retaining slope 30 engages the retaining edge 50 of the vaginal pelvic floor muscle platform 48. As the muscles of the pelvic floor 44 are contracted, the compressible material 34 is increasingly compressed, further exposing the retaining slope 30, which results in a stronger engagement of the retaining slope 30 with the retaining edge 50 of the vaginal pelvic floor muscle platform 48. This engagement of the device 10 with the retaining edge 50 facilitates the internal retention of the device 10 during the exercise of the muscles of the pelvic floor 44. As can be seen most clearly in FIG. 15 and FIG. 16, the head portion 14 makes little contact with the walls of the vagina beyond the retaining edge 50 of the vagina or pelvic floor muscle platform 48.

Figure 17:
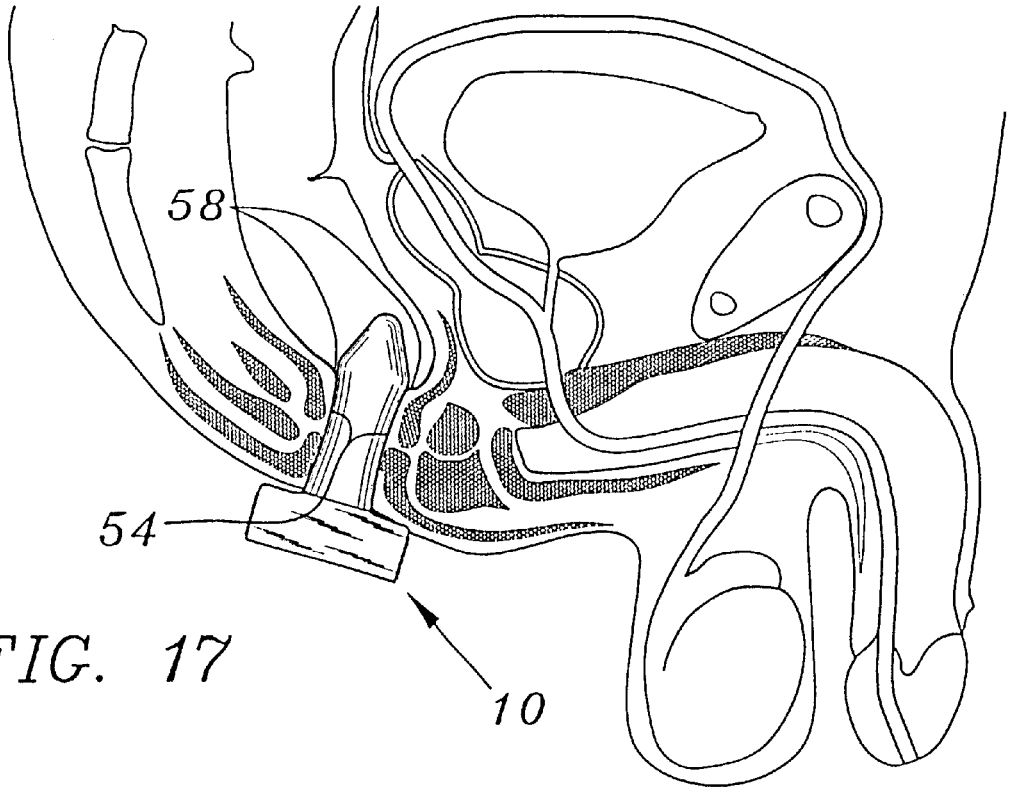
FIG. 17 is a line drawing of a portion of the male human anatomy, illustrating the positioning of the exerciser within the anal cavity with the muscles of the pelvic floor at rest.

In FIG. 17, the device 10 is shown inserted into a pelvic cavity, in this case the anal canal 52, so that the head portion 14 of the device 10 extends beyond the anal pelvic floor muscle platform (also known as "anal canal") 54 into the rectum 56 and the shaft portion 16 is sized and configured to match the length of the anal pelvic floor muscle platform 54. When the anal pelvic floor muscle platform 54 closes about the device 10, the muscles apply pressure against the shaft portion 16 even while the muscles are at rest. FIG. 3 illustrates the pressure of the muscles on the shaft portion 16 while the muscles are at rest. The retaining slope 30 engages the retaining edge 58 of the anal pelvic floor muscle platform 54. As the muscles of the pelvic floor 42 are contracted, the compressible material 34 is compressed further exposing the retaining slope 30, which results in stronger engagement of the retaining slope 30 with the retaining edge 58 of the anal pelvic floor muscle platform 54. This engagement of the device 10 with the retaining edge 58 facilitates the internal retention of the device 10 during the exercise of the muscles of the pelvic floor 42.

Figure 6:
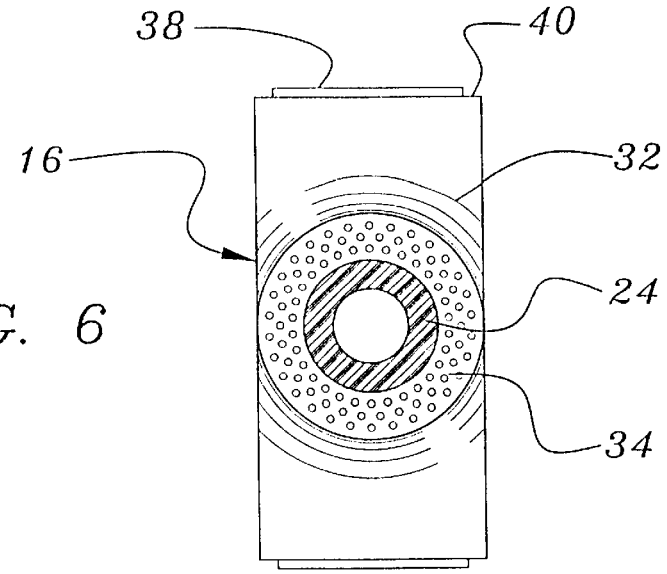
FIG. 6 is a cross-sectional view of the invention of FIG. 1, taken along line 6—6 of FIG. 2.
Figure 7:
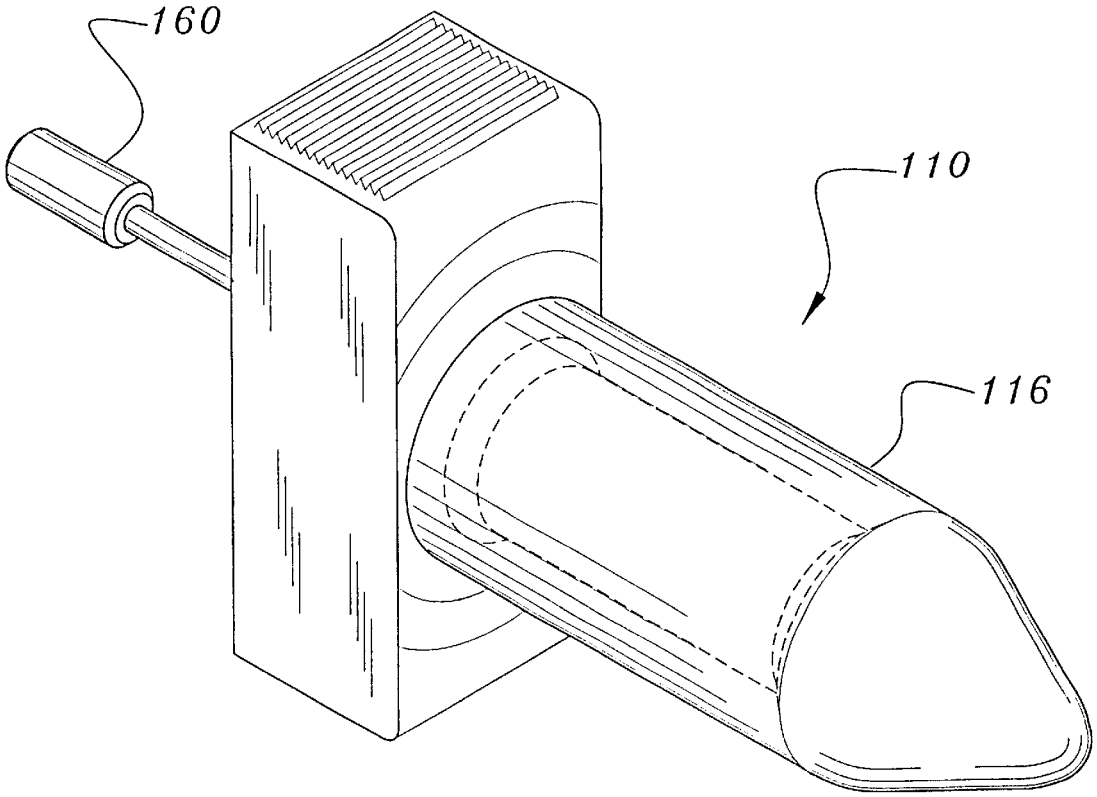
FIG. 7 is an isometric view of a second preferred embodiment of the invention.

In the preferred embodiment illustrated in FIG. 1–FIG. 6, as seen most clearly in FIG. 5 and FIG. 6 the device 10 is hollow for ease of manufacture, reduced costs and reduced weight for handling by the user. In addition, a thin layer of the compressible material 34 is extended over the head portion 14 to soften the surface of the head portion 14 and to eliminate the ridge that would be formed where the compressible material 34 would stop at the first end 26 of the shaft portion 16.

Figure 8:
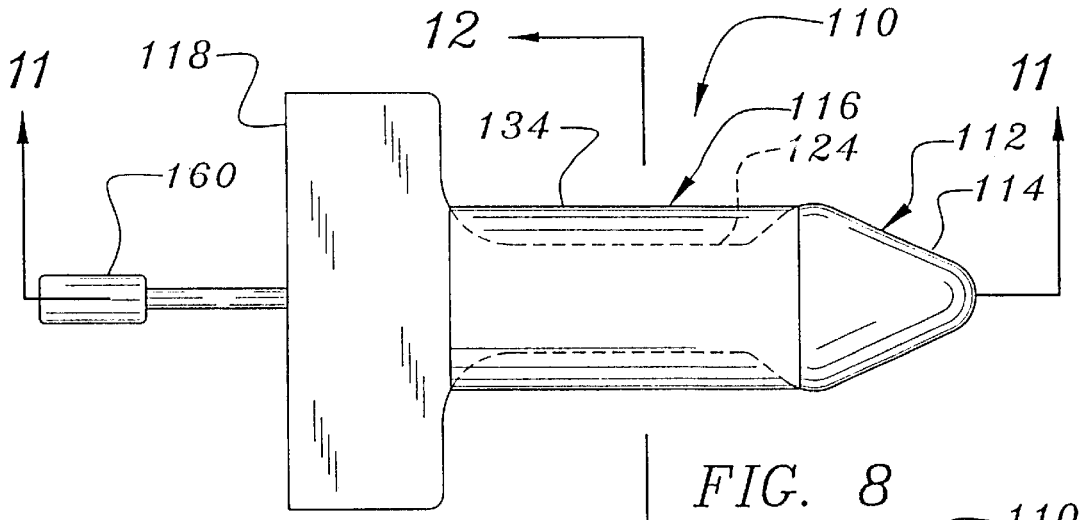
FIG. 8 is a front elevational view of the invention of FIG. 7.
Figure 9:
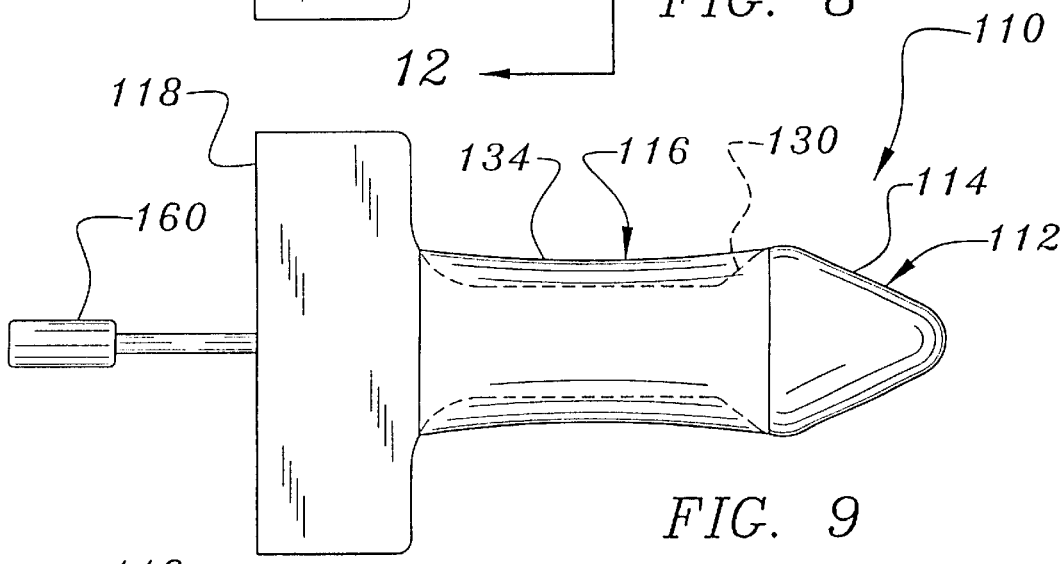
FIG. 9 is a front elevational view of the invention of FIG. 7, illustrating the partial compression of the compressible portion of the shaft portion when the device is inserted in a pelvic body cavity and the pelvic floor muscles are at rest.
Figure 10:
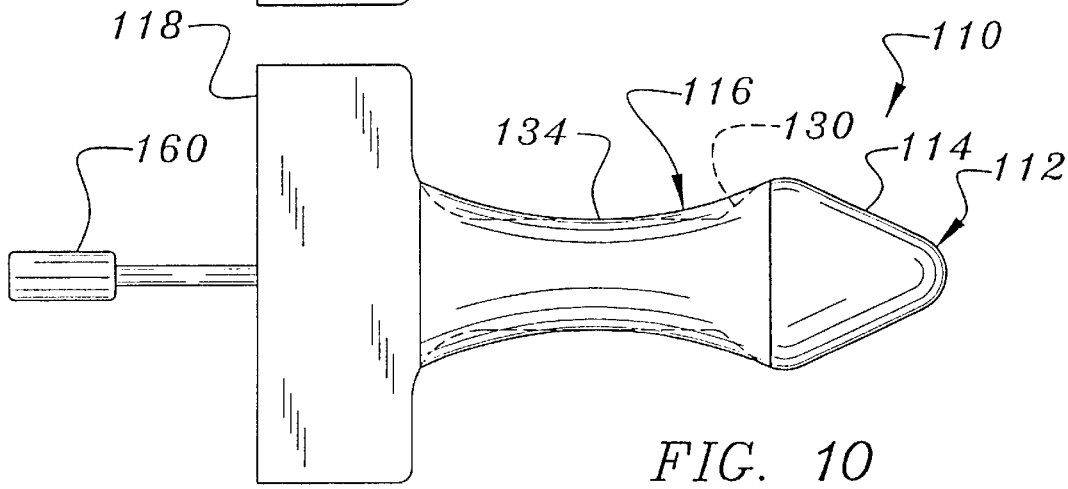
FIG. 10 is a front elevational view of the invention of FIG. 7, illustrating full compression of the compressible portion of the shaft portion when the device is inserted in a pelvic body cavity and the pelvic floor muscles are tightened.
Figure 11:
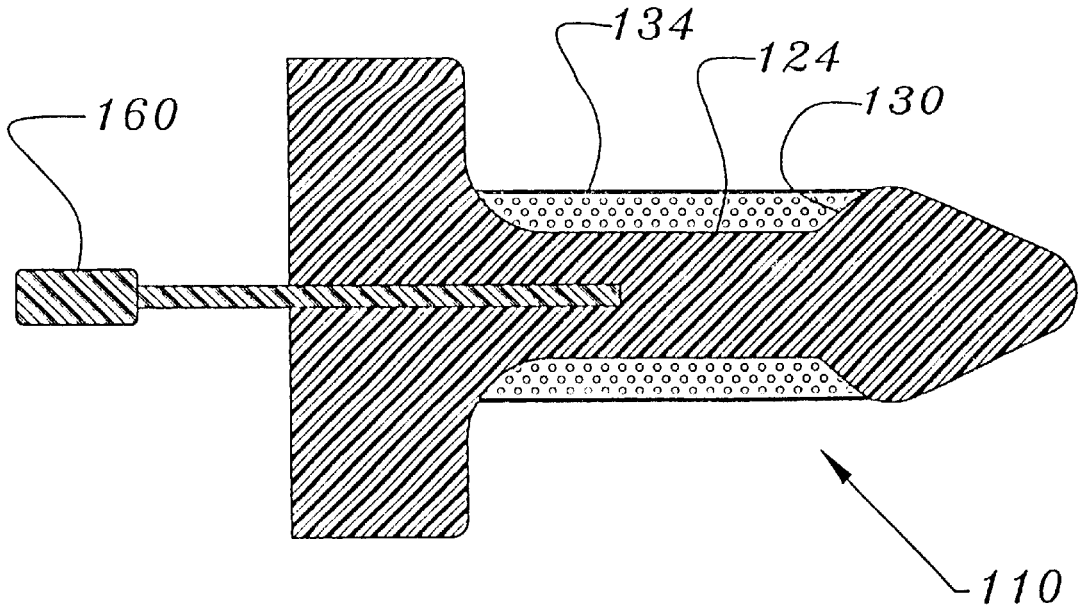
FIG. 11 is a cross-sectional view of the invention of FIG. 7, taken along the line 11—11 of FIG. 8.
Figure 12:
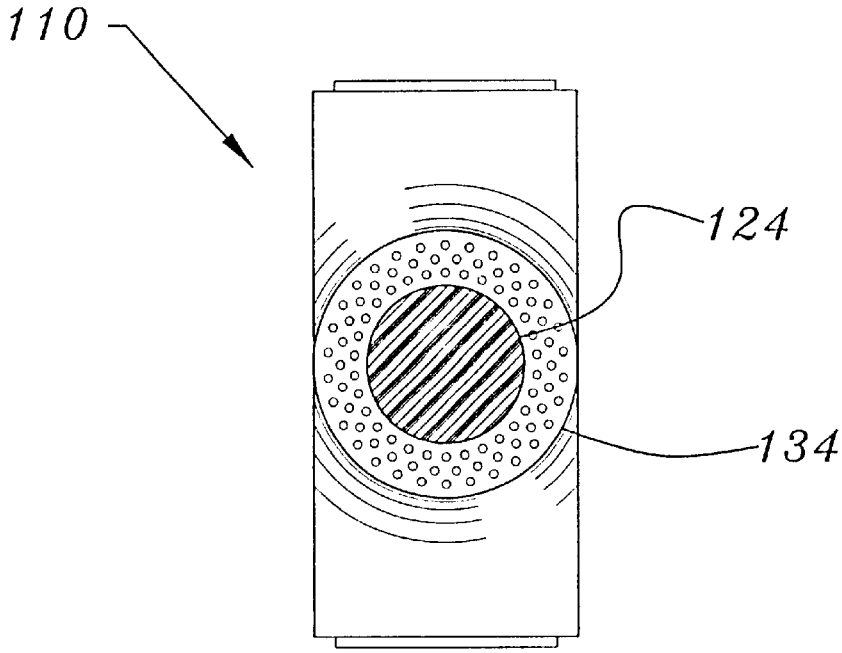
FIG. 12 is a cross-sectional view of the invention of FIG. 7, taken along line 12—12 of FIG. 8.

A second embodiment 110, illustrated in FIGS. 7–12 is configured in much the same manner as the preferred embodiment of FIGS. 1–6, with a member 112 that is comprised of a head portion 114 and a shaft portion 116. In this preferred embodiment, the shaft portion 116 is comprised of a solid rigid element 124, to support the attachment of an elongated handle 160, which is most clearly seen in FIG. 11 and FIG. 12. A layer of compressive material 34 is attached circumferentially to the rigid element 124. This preferred embodiment has the same retaining slope 130 disclosed in the first embodiment 10, The slope 130 is shown in FIG. 8, FIG. 9 and FIG. 10 as being increasingly exposed with the compression of the compressive material 134, as the muscles of the pelvic floor 42 and 44 are contracted.

A third embodiment 210, is illustrated in FIGS. 19–23. Referring first to the view of FIG. 19, it can be seen that the device 210 is comprised of a longitudinally extending member, generally indicated as 212, that includes a head portion 214 and a shaft portion 216. The device 10 also comprises a gripper, generally indicated as 218, which is attached to the member 212.

Figure 20:
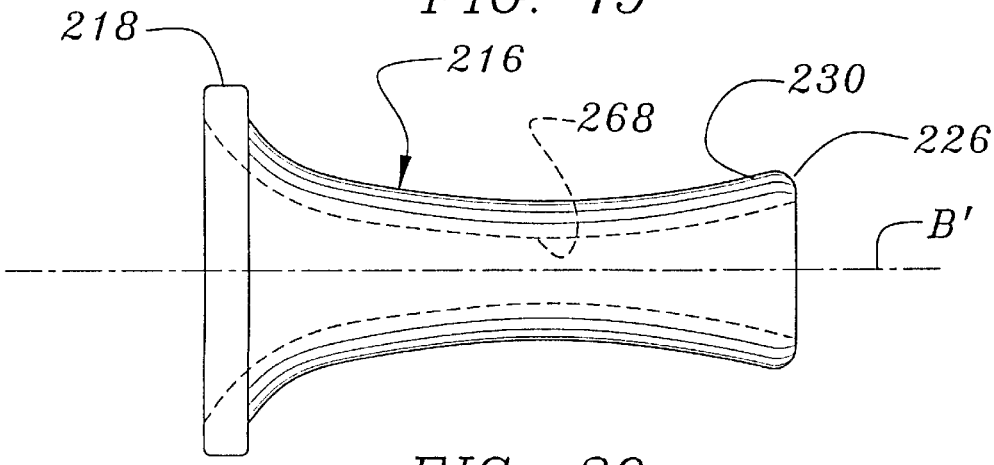
FIG. 20 is a front elevational view of compressible shaft portion of the invention of FIG. 19, illustrating the partial compression of the compressible portion of the shaft portion when the device is inserted in a pelvic body cavity and the pelvic floor muscles are at rest.
Figure 21:
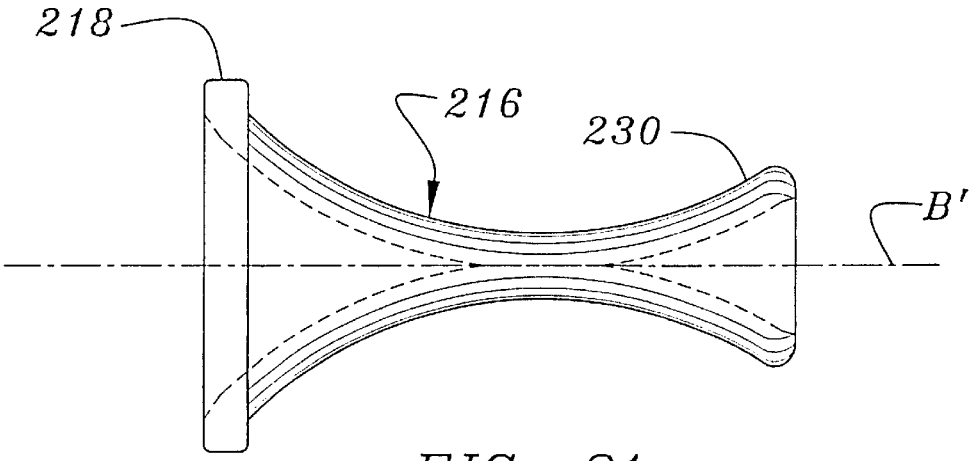
FIG. 21 is a front elevational view of the compressible shaft portion of the invention of FIG. 19, illustrating full compression of the compressible portion of the shaft portion when the device is inserted in a pelvic body cavity and the pelvic floor muscles are tightened.
Figure 22:
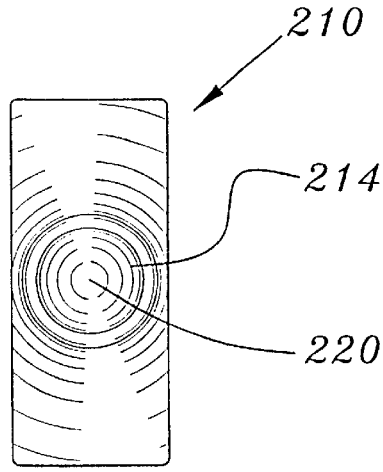
FIG. 22 is a right side elevational view of the invention of FIG. 19.
Figure 23:
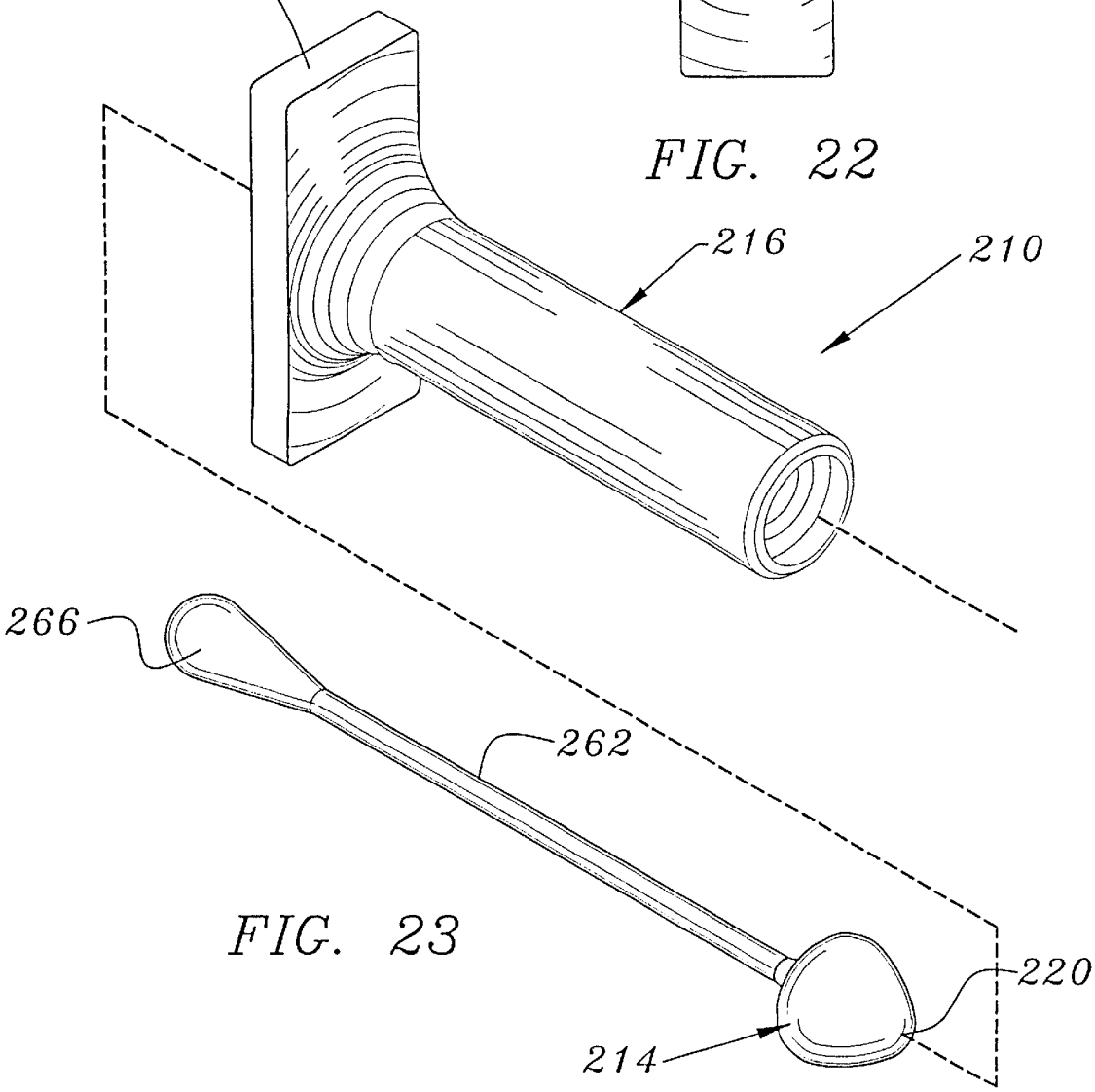
FIG. 23 is an isometric view of the invention of FIG. 19 illustrating the trocar removed.

The head portion 214 has a first end 220 and a second end 222, the second end of the head portion 214 being juxtaposed to the shaft portion 216. The first end 220 is formed as a blunt probe like insertion tip for ease in entering the body cavities through the vaginal or anal canals. The head portion 214 is tapered from its second end 222 to its first end 220 forming a gradual slope for comfort and ease of insertion of the device 210. The angle of the head portion 214 is generally the same as the angle A of the head portion 14 of the embodiment 10, generally 45 degrees. In this preferred embodiment, an elongated rod 262 is attached by its first end 264 to the head portion 214. The second end 266 of the rod 262 is sized and configured so that it extends through the shaft portion 216 and maybe gripped by the user. The shaft portion 216 is hollow having a bore 268 therethrough. The shaft portion 216 is made of a flexible synthetic resin, rubber, or other flexible and compressible material. The rod 262, with the head portion 214 attached, acts as a trocar and is in place within the shaft portion 216 to ease insertion of the device 210 into the pelvic body cavity. When the rod 262 and the attached head portion 214 is pulled back through the bore 268, as shown in FIG. 23, the shaft portion 216 remains in the vaginal or anal canal adjacent the muscles of the vaginal pelvic floor muscle platform 48 or the anal pelvic muscle platform 54, respectively. As shown in FIG. 20, once the shaft portion 216 is inserted and the muscles of the pelvic floor are at rest, they partially compress the shaft portion 216 to form a retaining slope 230 on the first end 226 of the shaft portion 216. The retaining slope 230 engages the retaining edge 50 of the vaginal pelvic floor muscle platform 48, or the retaining edge 58 of the anal pelvic muscle platform 54. As the muscles of the pelvic floor are contracted through exercise, as illustrated in FIG. 21, the shaft portion 216 is further compressed increasing the angle of the slope the retaining slope 230. The increased slope facilitates the internal retention of the shaft portion 216.

The second end 228 of the shaft portion 216 has an outwardly extending slope 232 which is angled in relation to the longitudinal axis B' of the shaft portion 216. The outwardly extending slope 232 is engageable with the tissue adjacent to the orifice of a pelvic body cavity when the member 212 is inserted into the pelvic body cavity. This engagement prevents over insertion of the member 212 into the pelvic body cavity. The outwardly extending slope 232 is angled sharply enough to ensure that the member 212 is prevented from totally entering the pelvic body cavity, and is preferably angled at approximately 90 degrees to the longitudinal axis B' as seen in FIG. 20.

Figure 24:
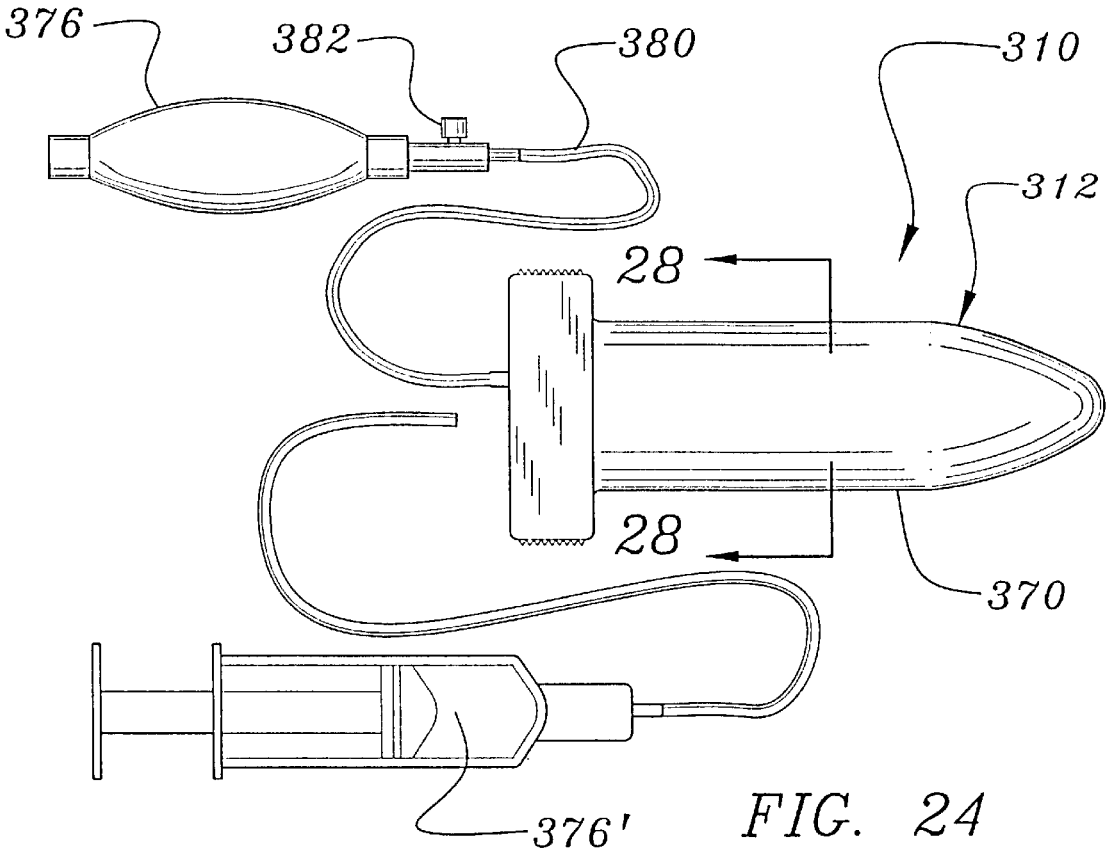
FIG. 24 is a front elevational view of a fourth embodiment of the invention.
Figure 25:
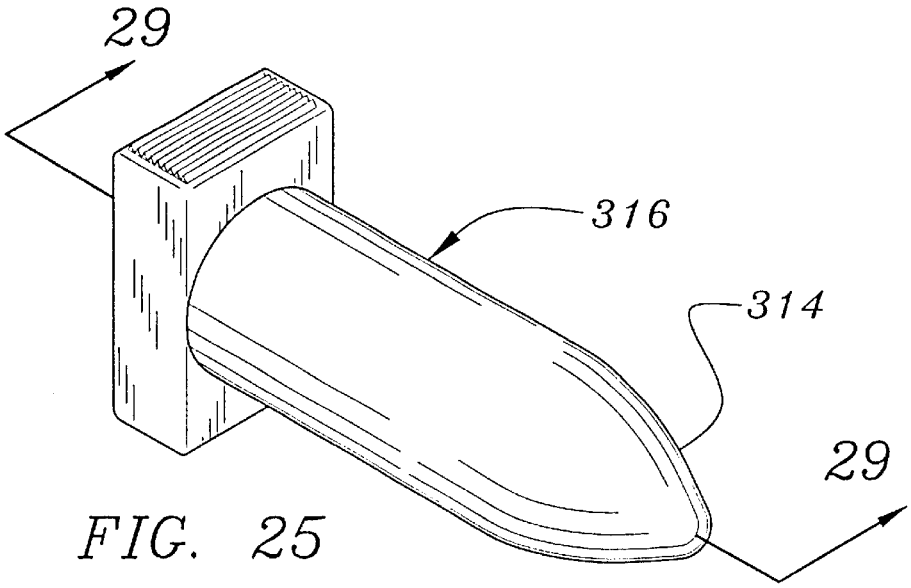
FIG. 25 is an isometric view of the invention of FIG. 24.
Figure 26:
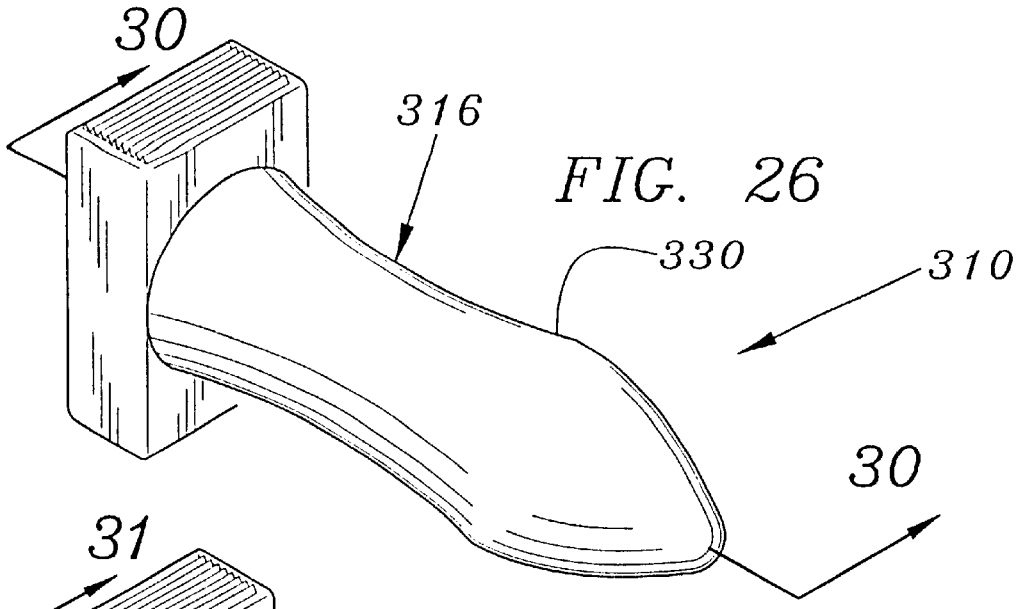
FIG. 26 is an isometric view of the invention of FIG. 24, illustrating the partial compression of the compressible portion of the shaft portion when the device is inserted in a pelvic body cavity and the pelvic floor muscles are at rest.
Figure 27:
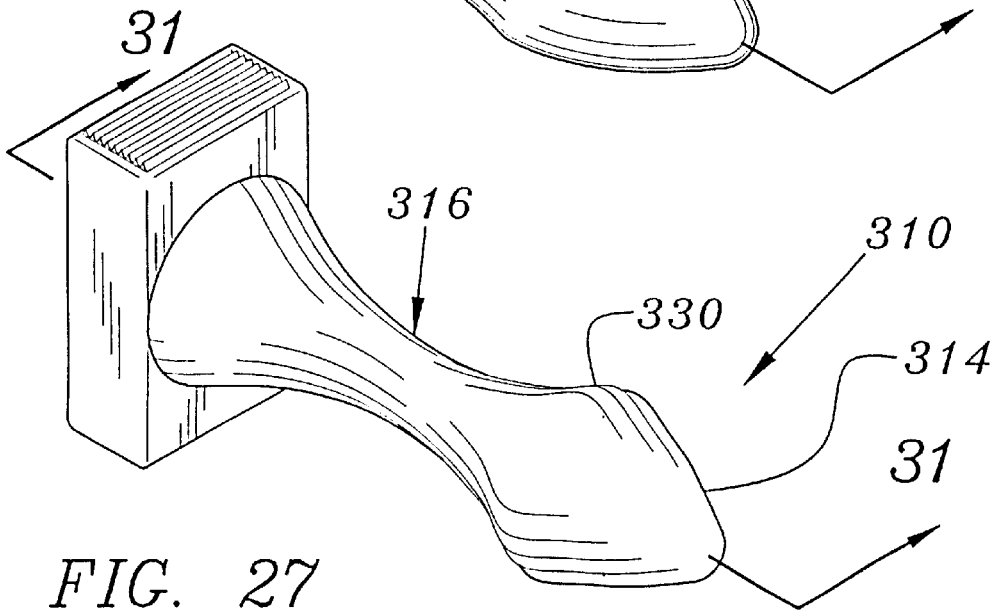
FIG. 27 is an isometric view of the invention of FIG. 24, illustrating full compression of the compressible portion of the shaft portion when the device is inserted in a pelvic body cavity and the pelvic floor muscles are tightened.
Figure 28:
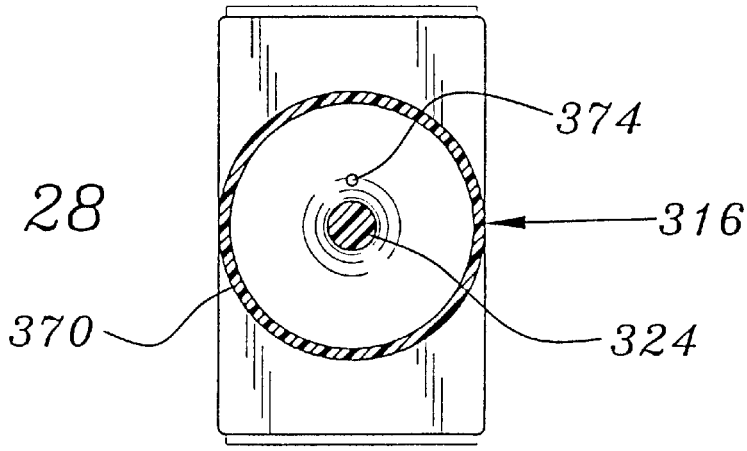
FIG. 28 is a cross-sectional view of the invention of FIG. 24 taken along line 28—28 of FIG. 24
Figure 29:
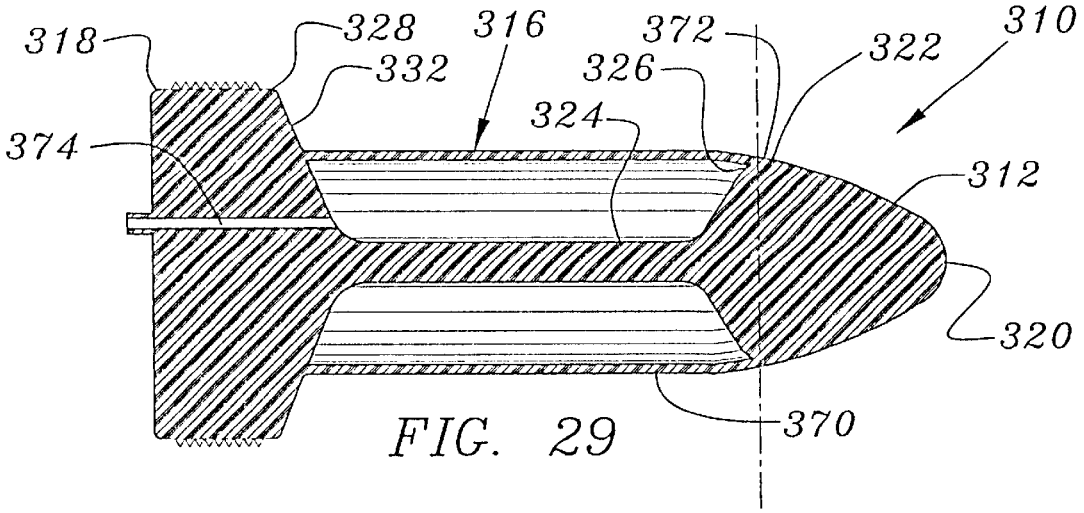
FIG. 29 is a cross-sectional view of the invention of FIG. 24 taken along line 29—29 of FIG. 25.
Figure 30:
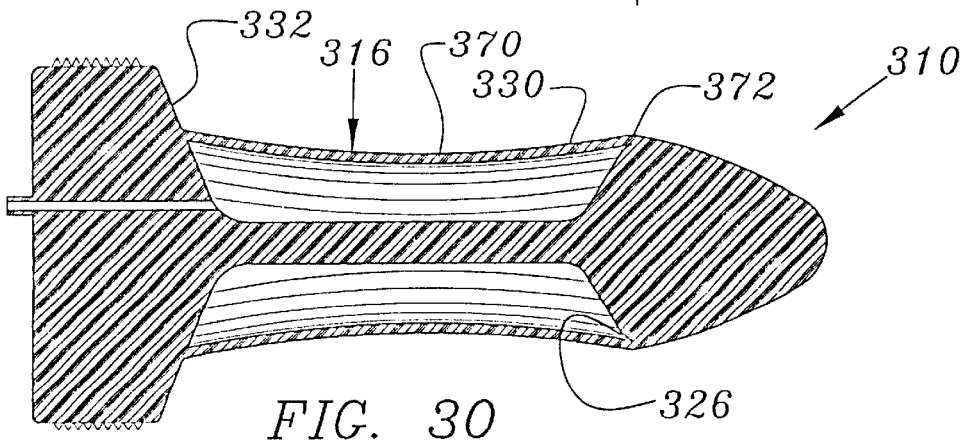
FIG. 30 is the cross-sectional view of the invention of FIG. 24 taken along line 30—30 of FIG. 26, illustrating the partial compression of the compressible portion of the shaft portion when the device is inserted in a pelvic body cavity and the pelvic floor muscles are at rest.
Figure 31:
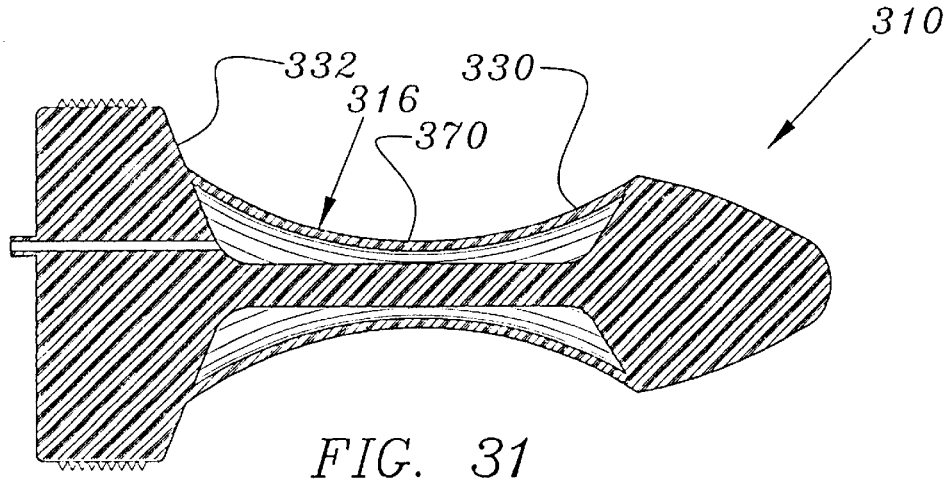
FIG. 31 is the cross sectional view of the invention of FIG. 24 taken along line 31—31 of FIG. 27, illustrating full compression of the compressible portion of the shaft portion when the device is inserted in a pelvic body cavity and the pelvic floor muscles are tightened.
Figure 32:
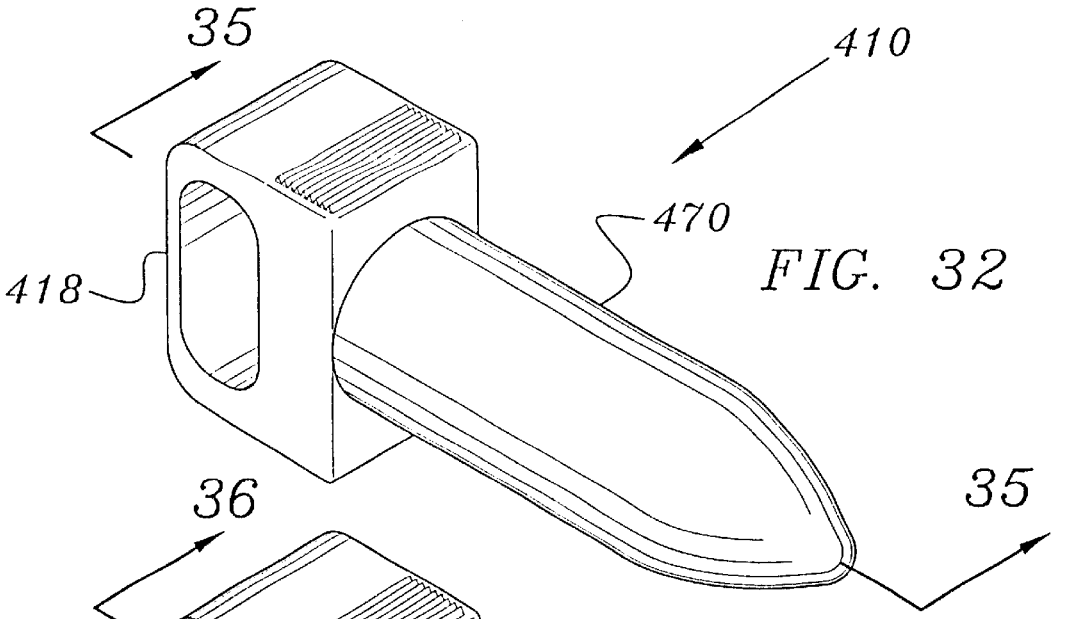
FIG. 32 is an isometric view of a fifth embodiment of this invention.
Figure 33:
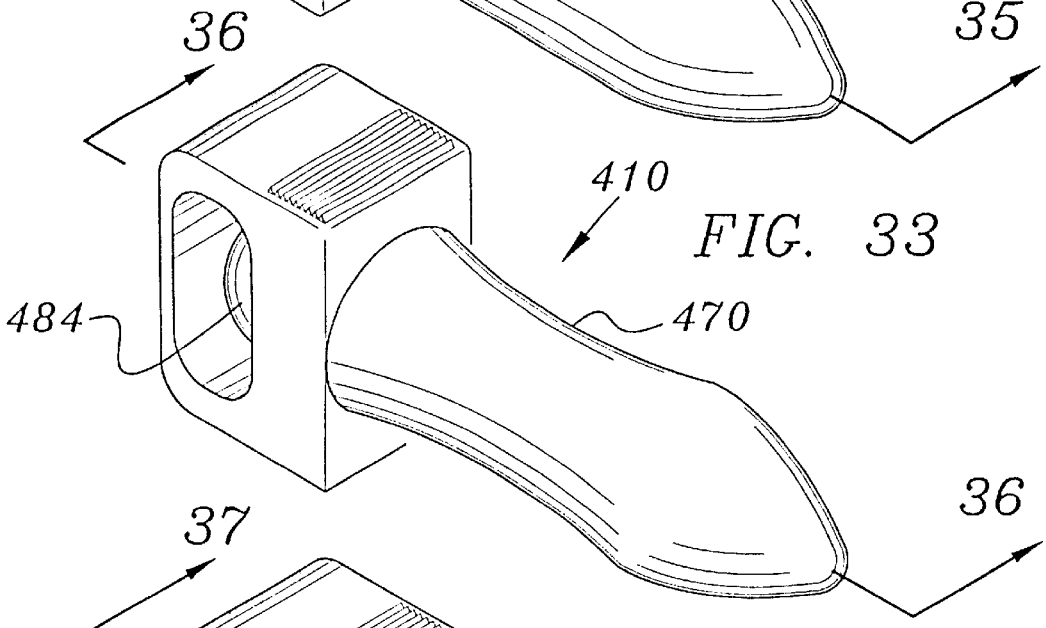
FIG. 33 is an isometric view of the invention of FIG. 32, illustrating the partial compression of the compressible portion of the shaft portion when the device is inserted in a pelvic body cavity and the pelvic floor muscles are at rest.
Figure 34:
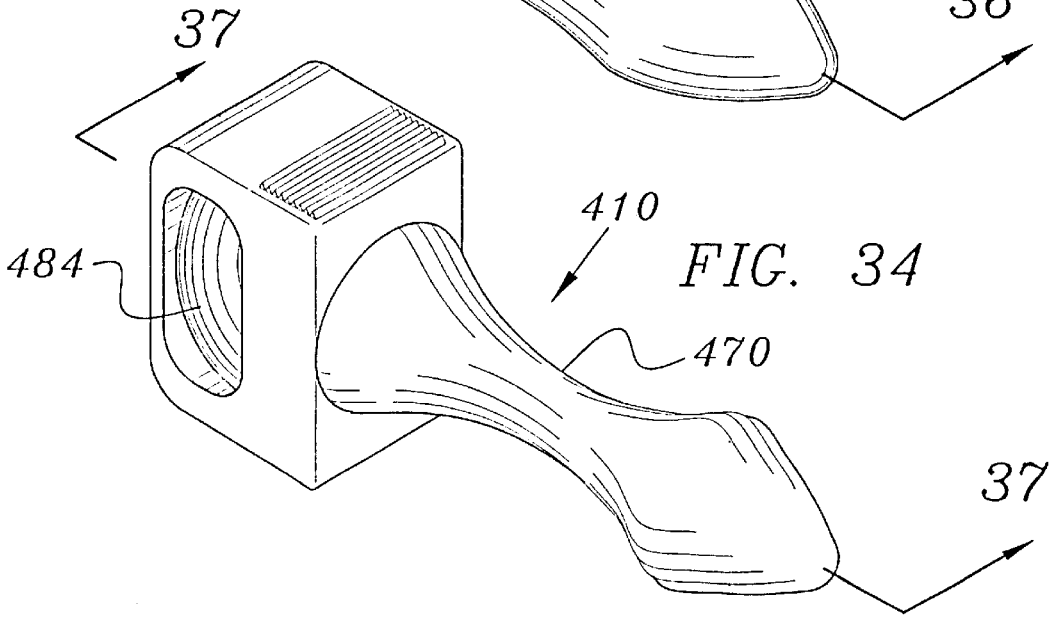
FIG. 34 is an isometric view of the invention of FIG. 32, illustrating full compression of the compressible portion of the shaft portion when the device is inserted in a pelvic body cavity and the pelvic floor muscles are tightened.
Figure 35:
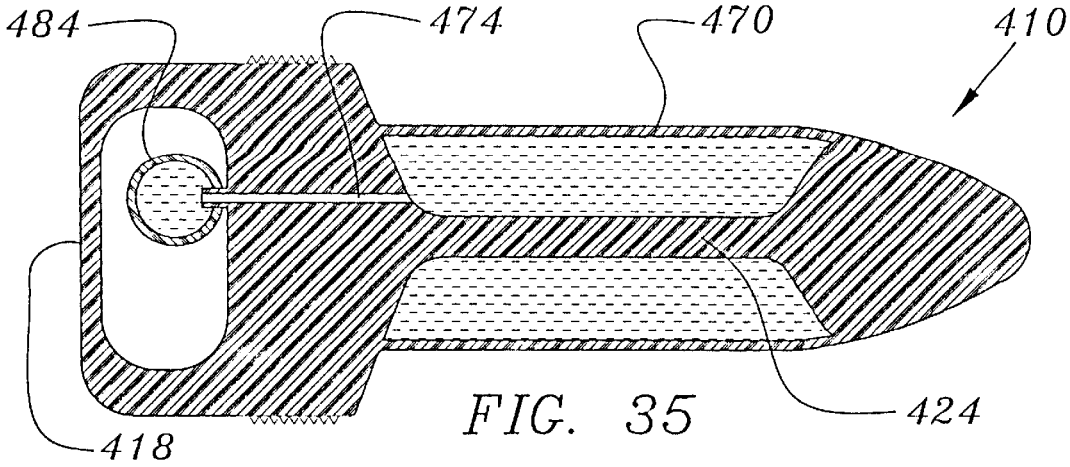
FIG. 35 is a cross sectional view of the invention of FIG. 32 taken along line 35—of the 35 of FIG. 32.
Figure 36:
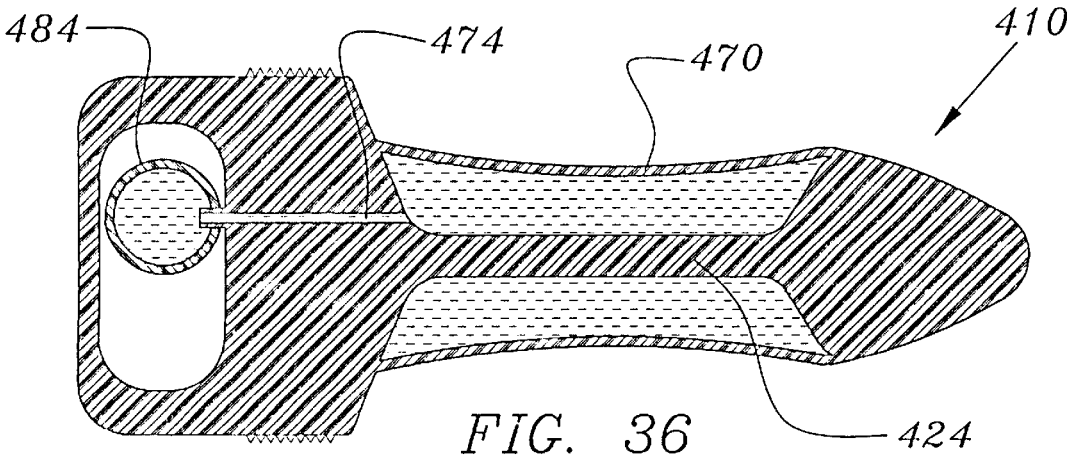
FIG. 36 is a cross sectional view of the invention of FIG. 32 taken along line 36—36 of FIG. 33.
Figure 37:
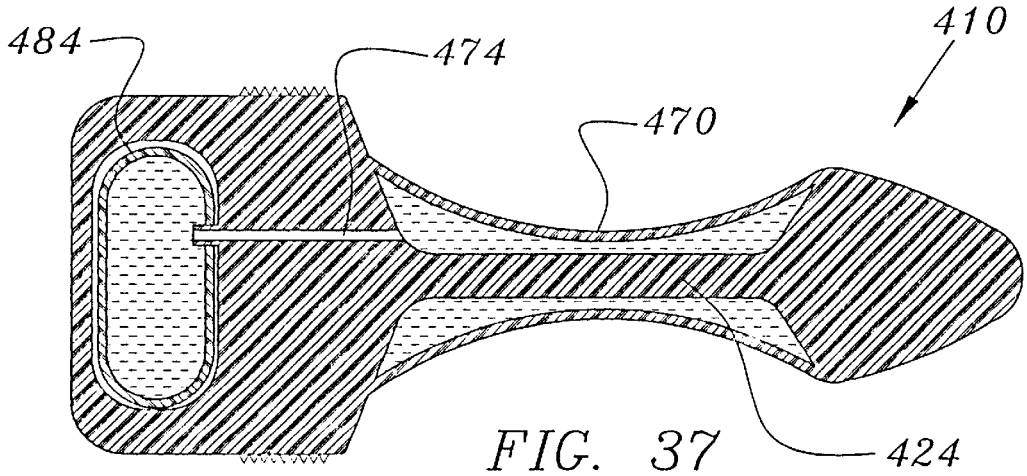
FIG. 37 is a cross sectional view of the invention of FIG. 32 taken along line 37—37 of FIG. 34.

FIGS. 24–31 illustrate a fourth embodiment 310 which is configured in a fashion similar to the first and second embodiments 10 and 110 respectively. In this case, the compressible element comprises a body of pressurized fluid, which may be air, water or any other suitable fluid. As seen more clearly in FIGS. 29, 30 and 31 the elongate member 312 comprises a head portion 314 and a shaft portion 316 as in the previous embodiments. The shaft portion 316 comprises a generally rigid element 324 having a first end 326 and a second end 328. The first end of the rigid element 324 is attached to the head portion 312 and the second end 328 is attached to the gripper 318. The shaft portion 316 further comprises a generally cylindrical flexible and impervious membrane 370 which is mounted at one end to the peripheral edge 372 of the head portion 312 and at the other end it is attached proximal the second end 328 of the rigid element 324 but any suitable well-known means. The membrane 370 circumferentially extends about the rigid element 324 forming a sealed space therein. A vent 374 extends through the second end 328 of the rigid member 324 and the gripper 318. so that it is in fluid flow communication with the sealed space and with a fluid reservoir 376 or an alternate fluid reservoir 376' as shown in FIG. 24. FIG. 28 further discloses the location of the vent 374 as seen in cross-section. As the muscles of the pelvic floor 42 or 44 are contracted, pressure is applied to the membrane 370 forcing fluid through the vent 374 into the reservoir 376. When the contraction is completed and the muscles have relaxed the fluid is pumped from the reservoir 376 back into the sealed space 378. The resistance may be varied by changing the size of the vent 374 or by restricting or enlarging the flow into the reservoir 376 by partially closing the tube 380 by adjustable means 382, which is a well-known apparatus that is similar to the flow control used in blood pressure cuffs. The syringe type reservoir can be manually controlled by maintaining pressure on the plunger increasing the resistance to flow into the reservoir 376'. As in the other embodiments, the retaining slope 330 is formed on the first end of the shaft 316 for the internal retention of the device 310 during exercise of the muscles of the pelvic floor 42 or 44. As in the other embodiments, and as seen in FIGS. 26 and 27 as well as FIGS. 30 and 31, the slope of the retaining slope 330 increases with the flexing of the muscles of the pelvic floor 42 or 44. On the second end 328 of the shaft 316 is formed an outwardly extending slope 332 which prevents the device 310 from being inserted too far into the pelvic cavity.

FIGS. 32, 33, 34, 35, 36, and 37 illustrate a fifth embodiment of the invention, which is very similar to the fourth embodiment with the exception that the reservoir comprises a bladder. The bladder 484 is attached to the vent 474 and remains in fluid flow communication with the sealed space about the rigid element 424. As the muscles of the pelvic floor 42 or 44 are flexed the membrane 470 is compressed inwardly as shown in FIGS. 33, 34, 36, and 37, forcing the fluid into the bladder 484, causing the bladder to expand. The exercising resistance may be varied by using bladders 484 which have varying resistance to expansion through use of different or thicker materials. In this preferred embodiment, the bladder 484 is shielded within the structure of the gripper 418.

Figure 41:
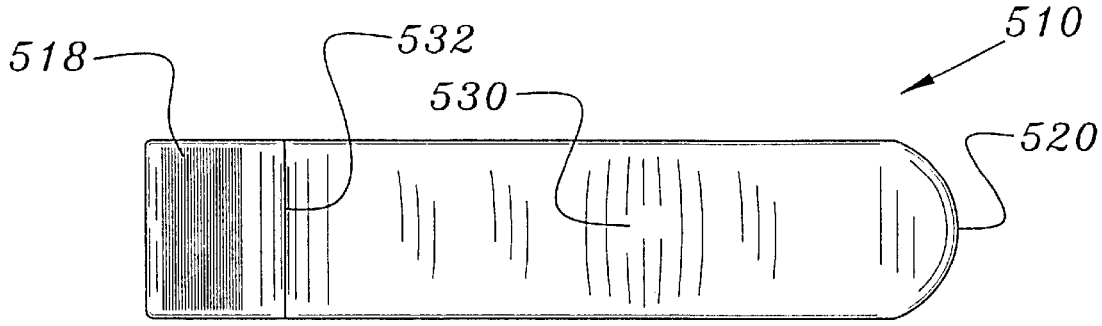
FIG. 41 is a front elevational view of the invention of FIG. 38.
Figure 42:
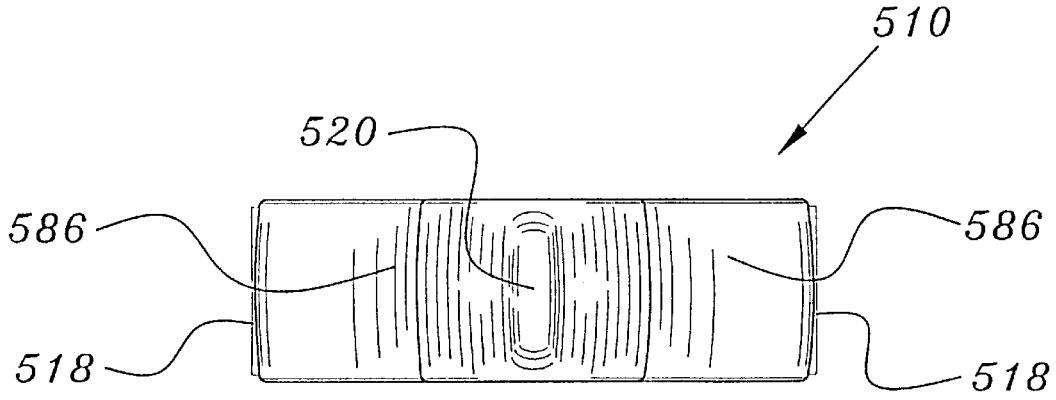
FIG. 42 is a right side elevational view of the invention of FIG. 38.
Figure 43:
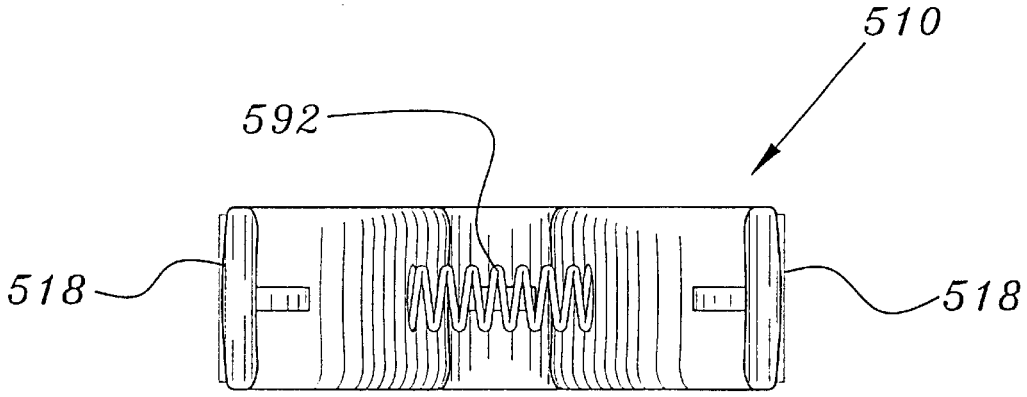
FIG. 43 is a left side elevational view of the invention of FIG. 38.
Figure 44:
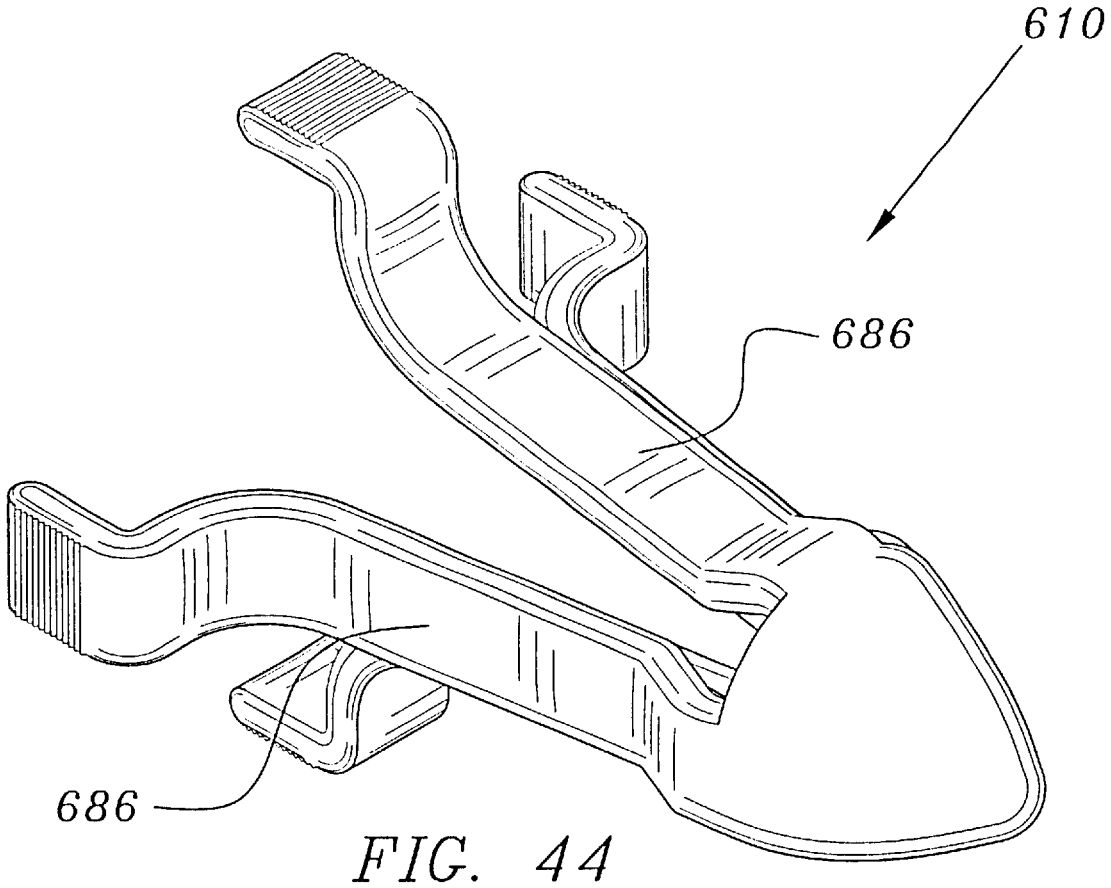
FIG. 44 is an isometric view of a seventh embodiment of this invention.
Figure 45:
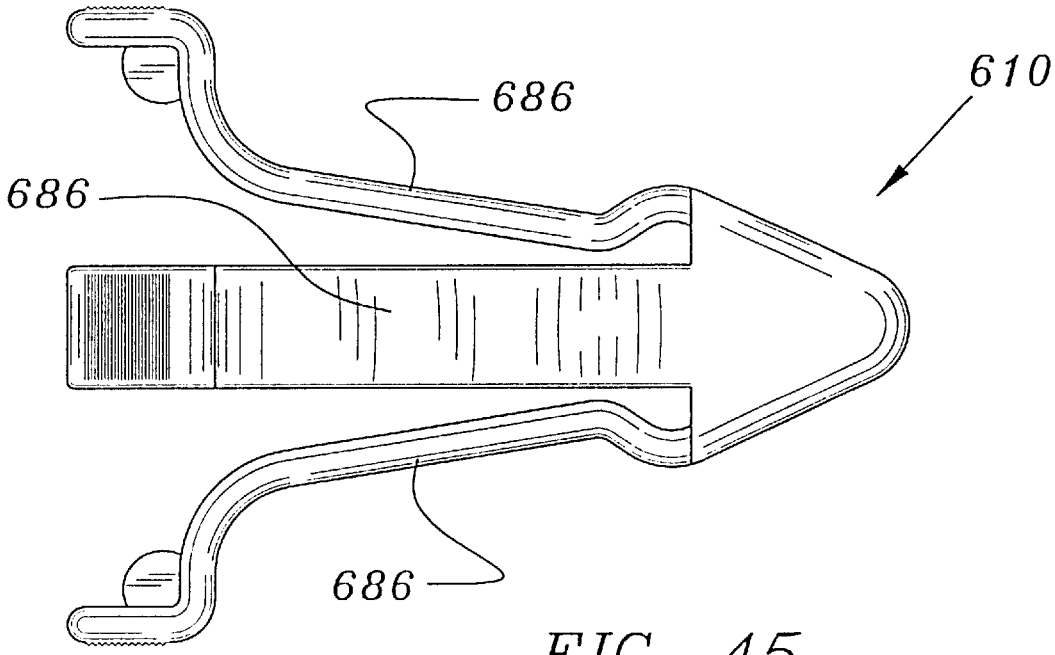
FIG. 45 is a top plan view of the invention of FIG. 44.
Figure 46:
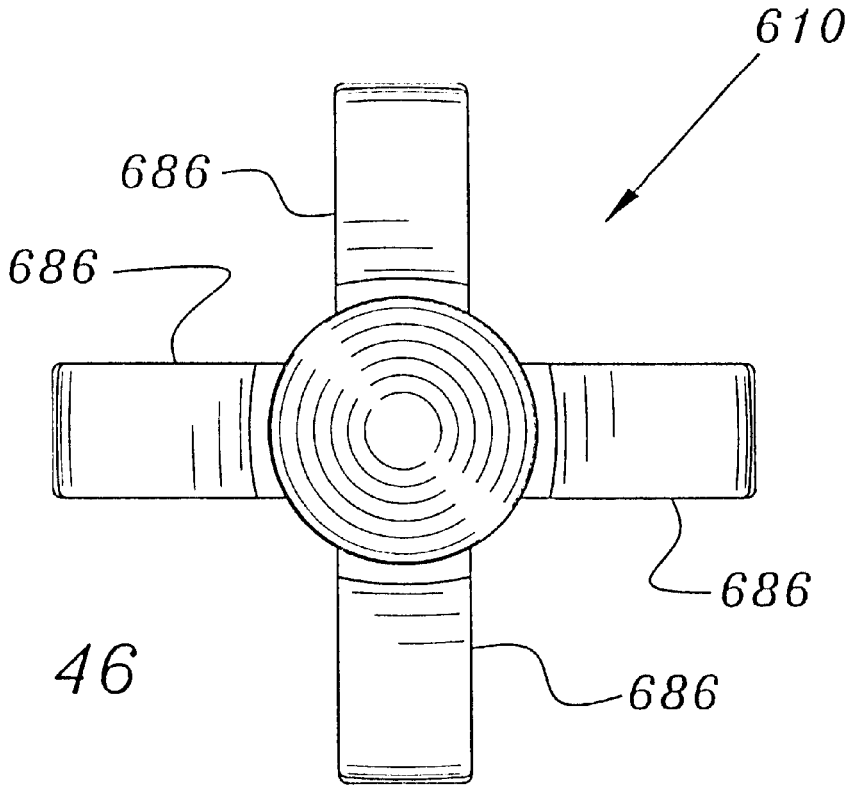
FIG. 46 is a right side elevational view of the invention of FIG. 44.
Figure 47:
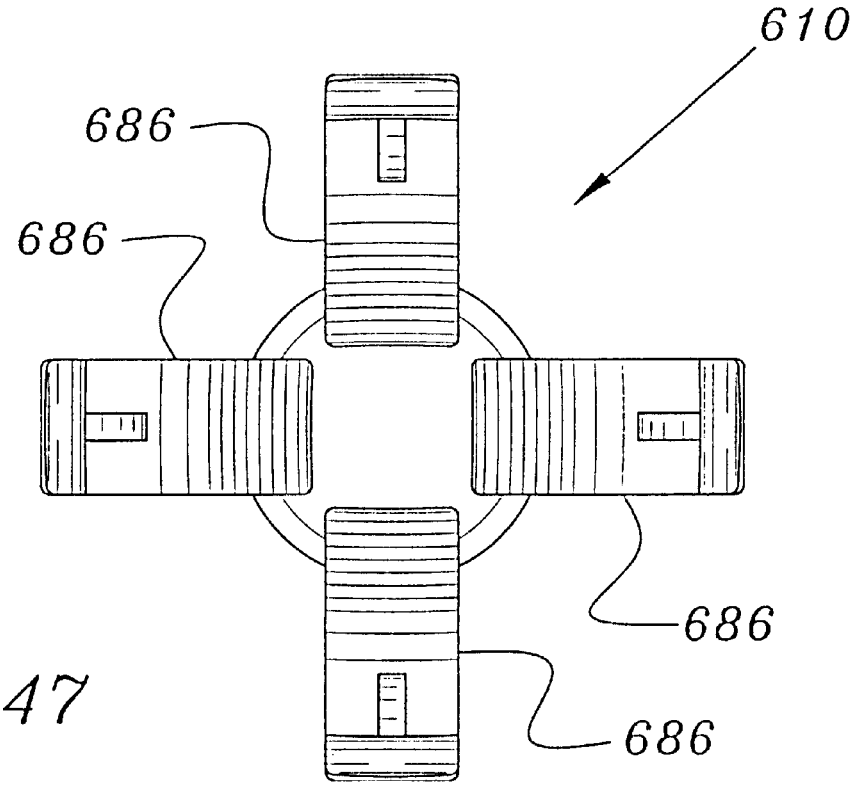
FIG. 47 is a left side elevational view of the invention of FIG. 44
Figure 48:
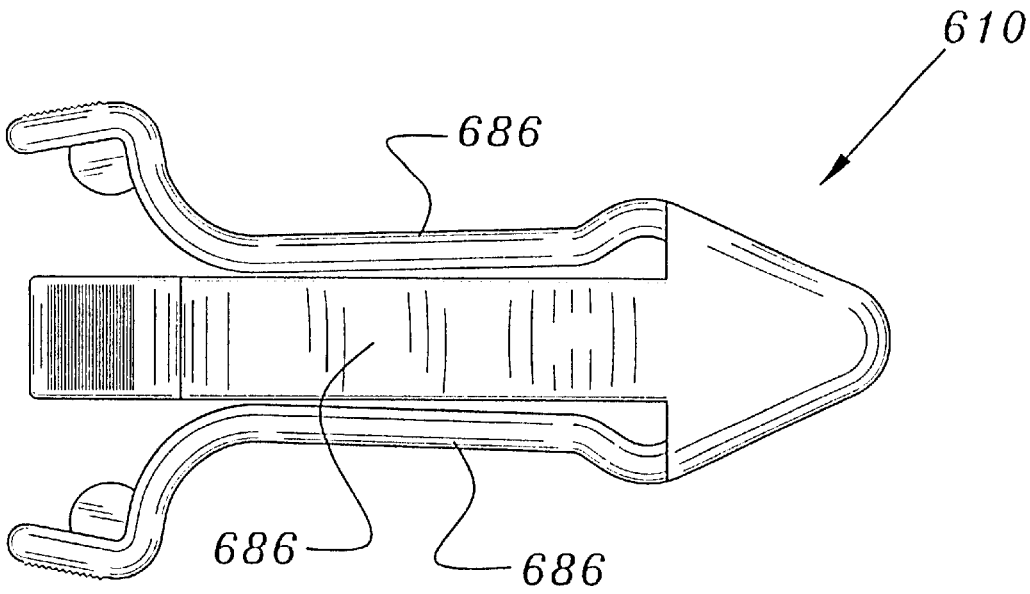
FIG. 48 is a top plan view of the invention of FIG. 44, illustrating full compression of the shaft portion of the invention when the device is inserted in a pelvic body cavity and the pelvic floor muscles are tightened.
Figure 49:
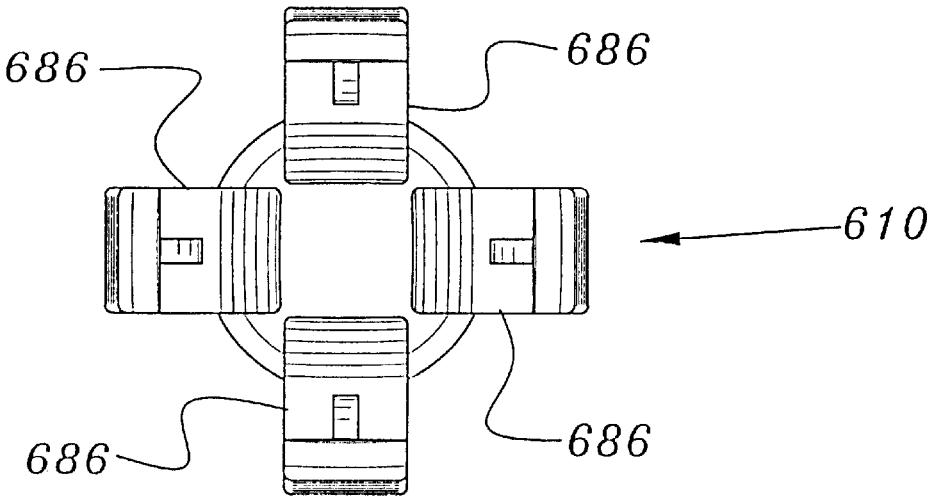
FIG. 49 is a left side elevational view of the invention of FIG. 44, illustrating full compression of the shaft portion of the invention when the device is inserted in a pelvic body cavity and the pelvic floor muscles are tightened.

A sixth embodiment of the current invention is illustrated in FIGS. 38–43. Referring first to the view of FIGS. 38 and 39, it can be seen that the device 510 comprises a first longitudinally extending member 512, that comprises a head portion 514 and a shaft portion 516. The shaft portion 516 conveniently comprises at least two legs 586, each having a first end 588 which is attached to the head portion 514. The head portion has a first end 520 and a second end 522, with a head portion being tapered from the second end 522 to the first end 520. The first end 520 is a blunt probe like insertion tip. A retaining slope 530 is formed on each leg 586 of the shaft 516. An outwardly extending slope 532 is formed on the second end 590 of each leg, which prevents the device 510 from completely entering a pelvic body cavity during exercise. The shaft 516, conveniently legs 586, are compressible as they may be squeezed together. As in the other preferred embodiments, the retaining slope 530 is engageable with a retaining edge of the adjacent muscle platform when the member 512 is inserted within a pelvic body cavity and the muscles of the pelvic floor are at rest and when the muscles of the pelvic floor are contracted during exercise. The slope 532 is engageable with the tissue adjacent to the orifice of a pelvic body cavity which prevents over insertion of the member 512. FIGS. 41,42 and 43 provide additional views to more fully understand the embodiment 510.

When the device 510 is inserted within a pelvic body cavity the muscles contract moving the legs 586 toward one another exercising the muscles against resistance and through distance. In this embodiment, resistance may be increased by inserting and attaching a biasing means, conveniently a spring 592, mounted between the legs 586 as shown in FIG. 39. By varying the spring strength, the level of resistance to muscle contraction, hence the levels of exercise, may be varied. Another method for increasing the resistance of the movement of the legs 586 toward one another is to insert a resistance body 594 between the first ends 588 of the legs 586. The resistance body 594, most clearly seen in FIG. 40, may be attached to legs 586 by a tongue 596 formed on two sides of the resistance body 594 and a corresponding groove 598 formed on each leg. The resistance body 594 is sized and configured to fit within the angle between the legs 586 so that the resistance body 594 may be simply snapped into place. By varying the size of the resistance body, the resistance of the device 510 to compression may be increased or decreased, providing the ability to vary resistance to muscle contraction, hence modify the exercise program. A gripper 518 is formed on the second ends of the legs 586 for ease of insertion and removal of the device from a pelvic cavity.

FIGS. 44–49 illustrate a seventh embodiment, generally indicated as 610, which is very similar to the sixth embodiment, with the exception that the seventh embodiment comprises four legs 686 which operate in the same fashion as in preferred embodiment 510, except it is necessary to grip all four legs 686 during insertion. Device 610 provides a more even application of resistance to the contraction of the muscles of the pelvic floor 42 or 44, than the embodiment 510. This embodiment is illustrated in FIGS. 44, 45, 46, 47, 48, and 49, which provide various views of the device 610 for a complete understanding of its operation.

Figure 50:
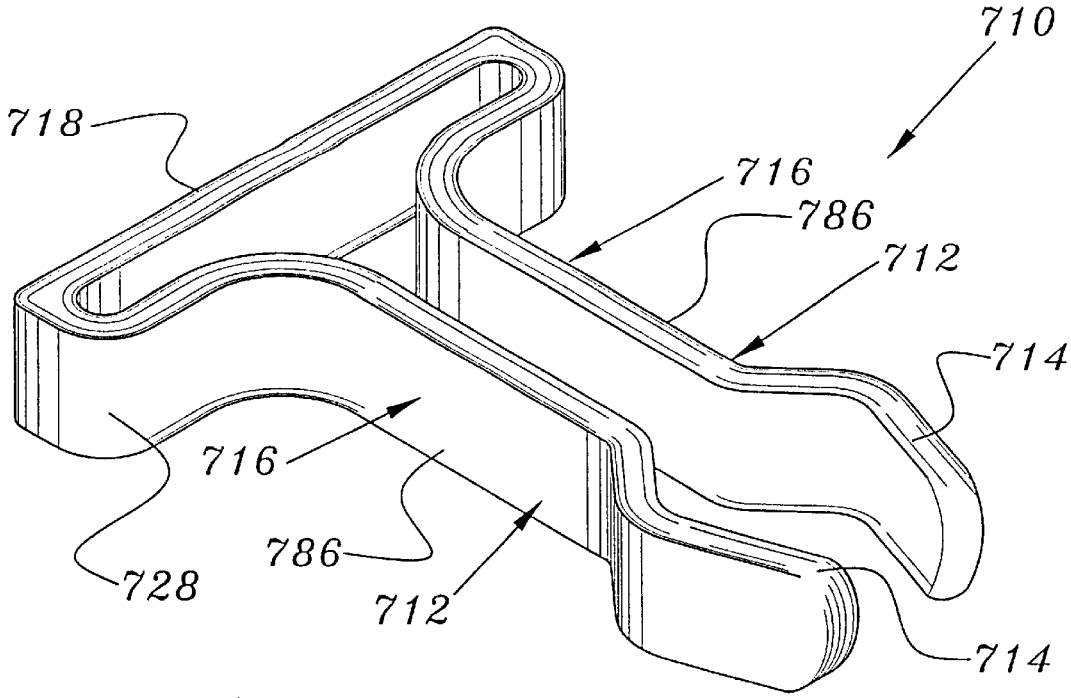
FIG. 50 is an isometric view of an eighth embodiment of this invention.
Figure 51:
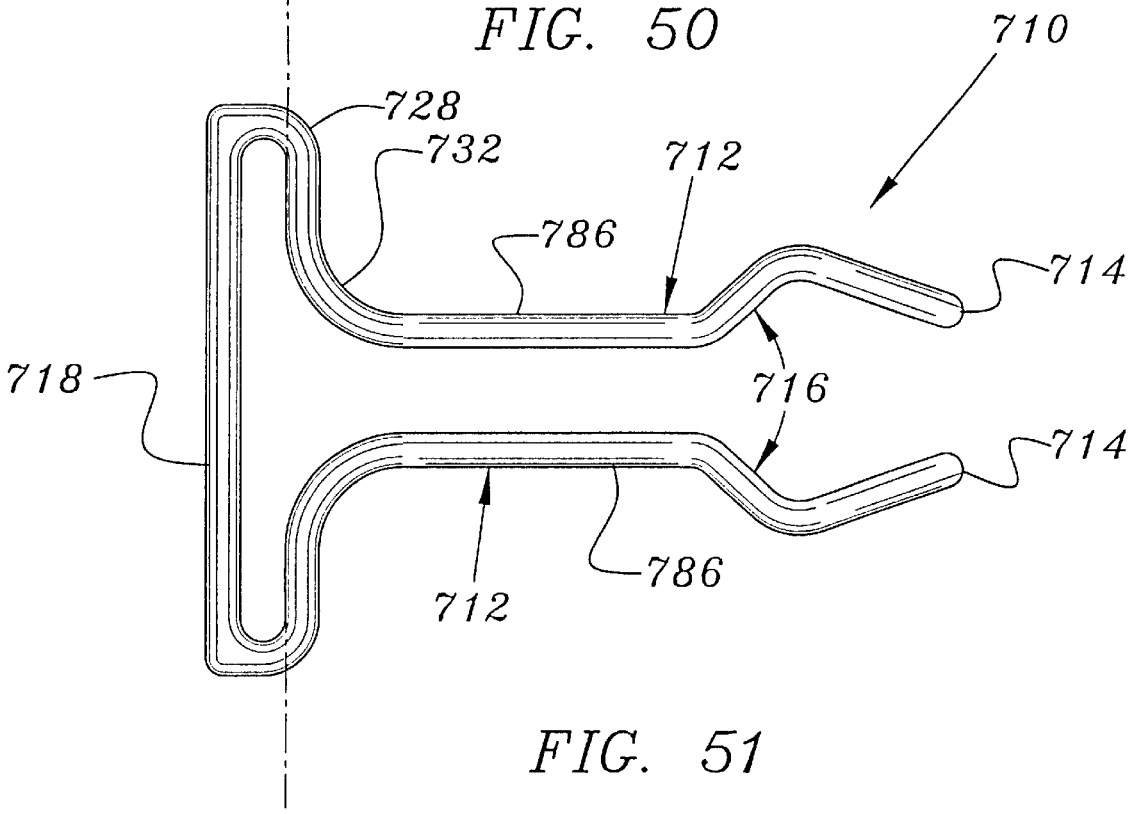
FIG. 51 is a top plan view of the invention of FIG. 50.
Figure 52:
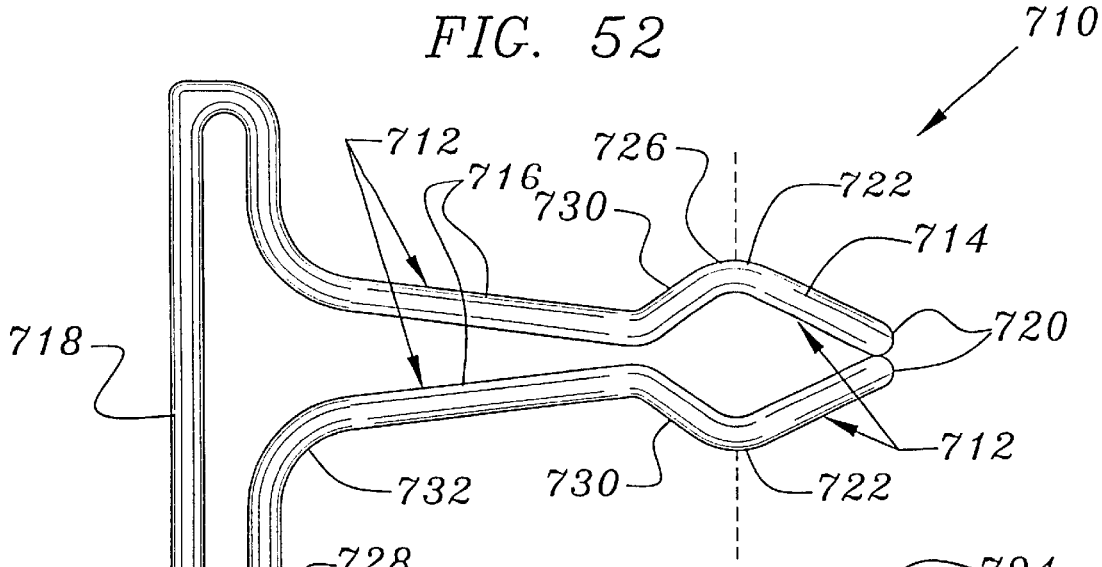
FIG. 52 is a top plan view of the invention of FIG. 50 illustrating compression of the shaft portion of the invention in preparation for insertion in a pelvic body cavity.

FIGS. 50–59 illustrate an eighth embodiment of the invention, generally indicated as 710. As shown in FIGS. 50, 51 and 52, the apparatus comprises a longitudinally extending member 712, which is further comprised of a head portion 714 and a shaft portion 716. As in the sixth embodiment, the shaft 716 comprises a pair of legs 786; however, in this case the legs 786 are attached to the gripper 718 connecting the legs 786 to one another. The shaft 716, conveniently legs 786, are compressible, being capable of being pressed or squeezed together. In this embodiment the legs 716 are compressed bending largely at their attachment point to the gripper 718 and also somewhat along their length.

The head portion 714 is attached to and therefore juxtaposed with the first end 726 of the shaft portion 716. As seen in FIGS. 50–52 the head portion 714 is comprised of two parts, with one part attached to the first end of one leg and the other part attached to the first end of the other leg. As seen in FIG. 52, when the shaft is compressed, the two parts of the head portion 714 are proximal one another, to form a blunt first end 720, that comprises a probe like insertion tip, and a second end 722. The head portion 714 is tapered from the second end 722 to the first end 720 providing a gradual slope for insertion into a pelvic body cavity. As in the other embodiments, the angle of the first end of the head portion is generally 45 degrees, but may be varied as long as the ease of insertion and the user's comfort is maintained. As seen in FIG. 52, the first end 726 of the shaft 716 has an outwardly extending retaining slope 730 formed thereon, which, as in the other embodiments, is engageable with the retaining edge of the adjacent pelvic floor muscle platform when the member 712 is inserted within a pelvic body cavity and the muscles of the pelvic floor are at rest. This retaining slope 730 retains the member 712 within the pelvic body cavity when the muscles of the pelvic floor muscle platform are contracted. This was completely described in the discussion of the first embodiment, which is supported by the drawing FIGS. 13–18. The embodiment 710 could be substituted for the embodiment 10 shown in these drawings. An outwardly extending slope 732 is formed on the second end 728 shaft portion 716. The outwardly extending slope 732 is engageable with the tissue adjacent to the orifice opening into the pelvic body cavity, when the member 712 is inserted into a pelvic body cavity, which prevents over insertion of the member 712. FIG. 52 illustrates the device 710 in position for insertion into a pelvic body cavity.

Figure 53:
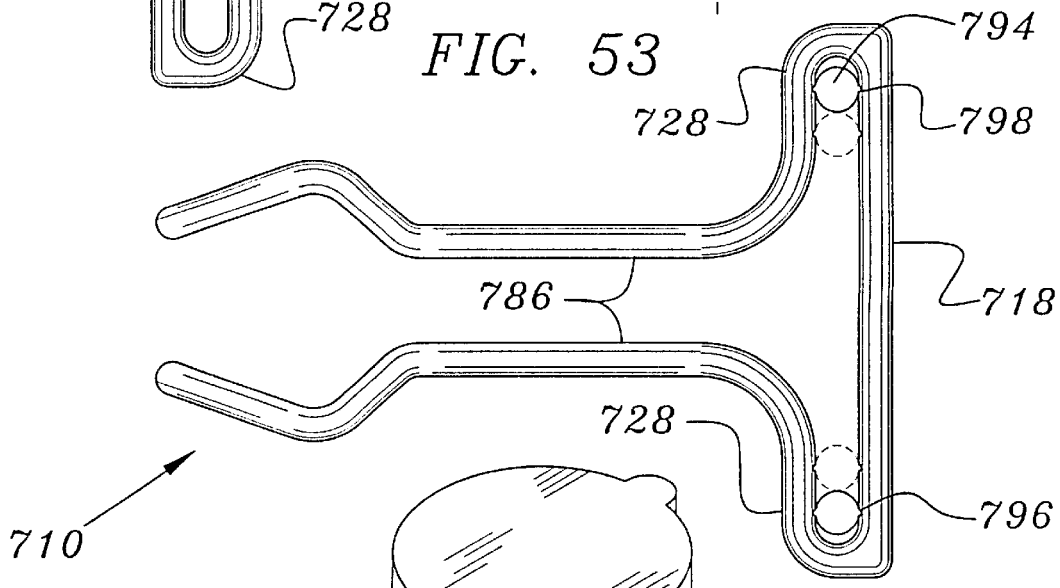
FIG. 53 is a top plan view of the invention of FIG. 50, illustrating the use of resistance bodies to modify the resistance of the invention to compression.
Figure 54:
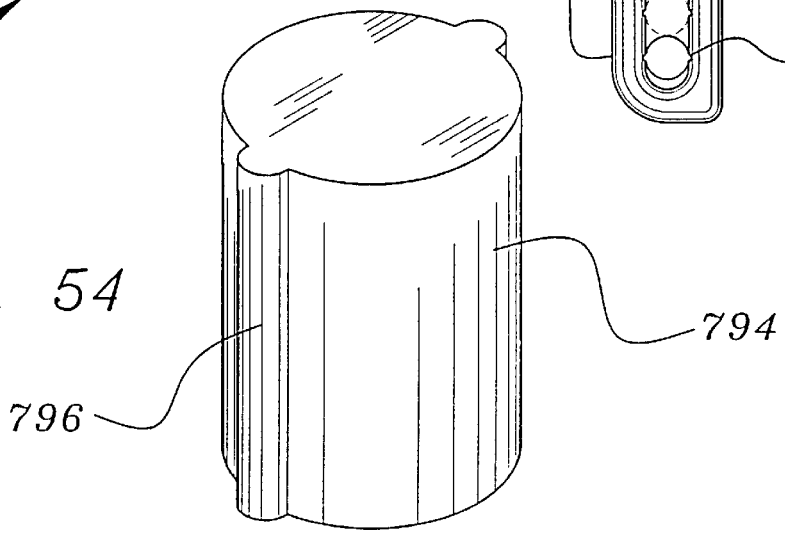
FIG. 54 is a detailed isometric view of a resistance body of FIG. 53.

When the device 710 is inserted within a pelvic body cavity, and the muscles of the pelvic floor 42 and 44 are contracted, the legs move toward one another, and when the muscles are relaxed the legs are biased so that they move away from one another. The biasing means is established in the attachment to the gripper 718 and the properties of the material from which the device 710 is constructed. In a preferred embodiment the device 710 is constructed from a generally rigid synthetic resin, but may be constructed from any material suitable for the purpose. The resistance to the muscle contractions maybe adjusted by using less resilient material or thicker material. As in the previous embodiment, a resistance body 794 shown in FIG. 54 may be inserted between the second ends 728 of the legs and the gripper 718, which reduces the flexibility of the legs 786 and increases the resistance of the legs to compression, that is, movement toward one another. As seen in FIG. 53, a plurality of resistance bodies 794 may be used to adjustably very the resistance. In other embodiments, a larger single body may be used in place of multiple bodies. A resistance body 794 is snapped into place by the use of a pair of tongues 796 formed on the resistance body 794 and a pair of grooves 798, one formed on each of the opposing portions of the legs 786 and the gripper 718.

Figure 55:
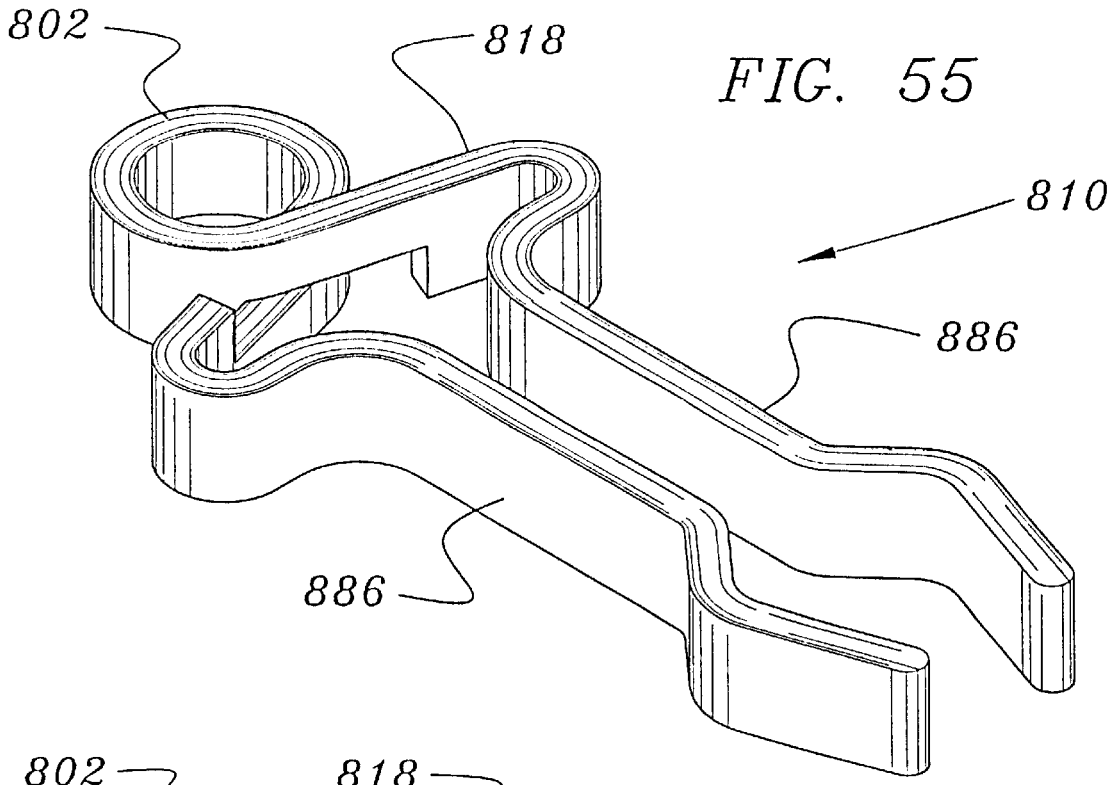
FIG. 55 is an isometric view of a ninth embodiment of this invention.
Figure 56:
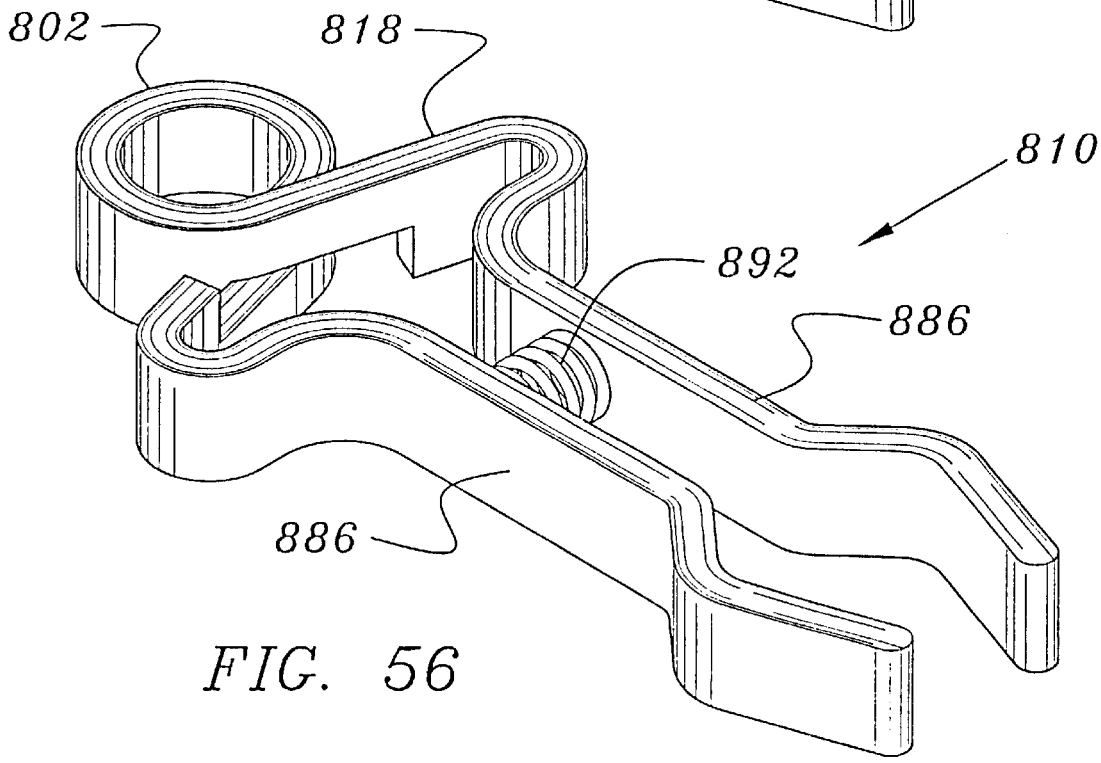
FIG. 56 is isometric view of the invention of FIG. 55 illustrating the use of a spring as a biasing means.
Figure 57:
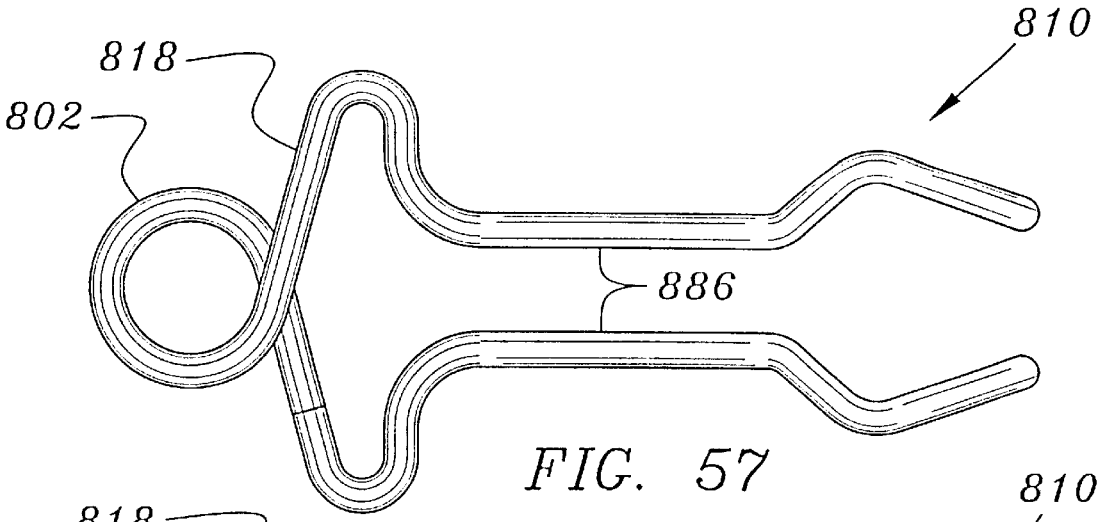
FIG. 57 is a top plan view of the invention of FIG. 55.
Figure 58:
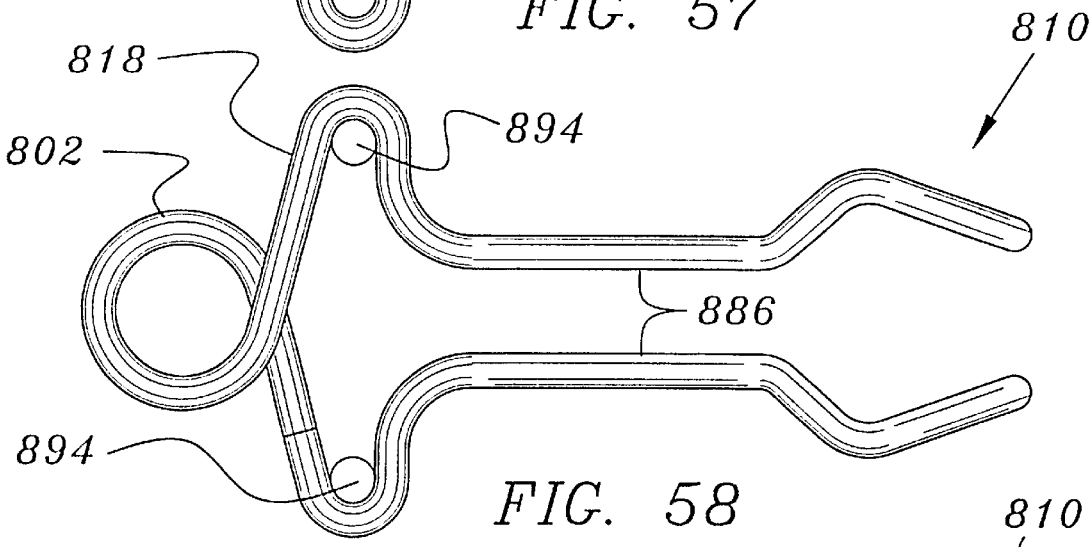
FIG. 58 is a top plan view of the invention of FIG. 55, illustrating the use of a resistance body to modify the resistance of the invention to compression.
Figure 59:
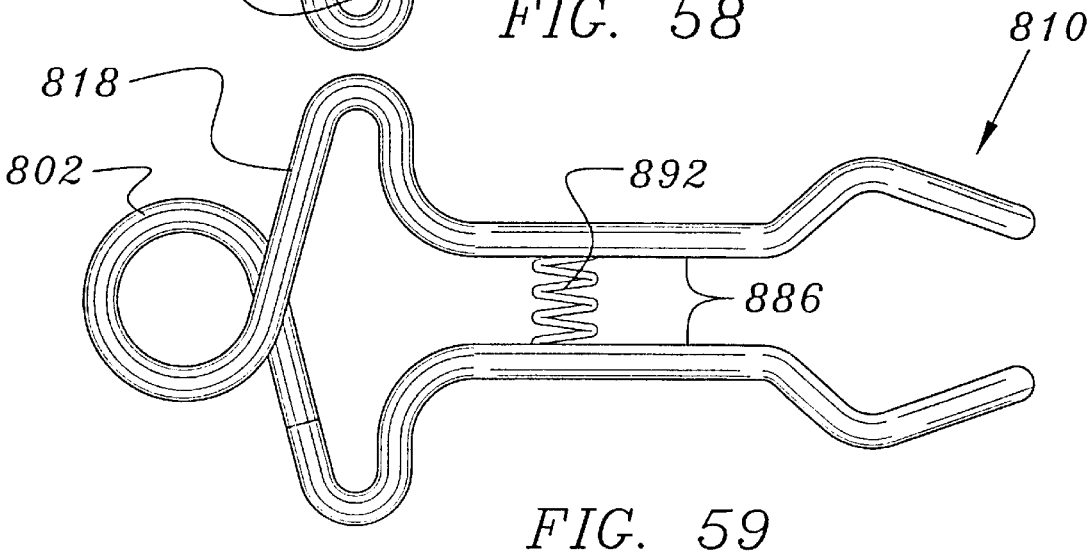
FIG. 59 is a top plan view of the invention of FIG. 55 illustrating the use of a spring to increase resistance of the invention to compression.

FIGS. 55–59 illustrate a ninth preferred embodiment, generally indicated as 810. This preferred embodiment, as shown in FIGS. 55, 56 and 57, operates substantially in the same manner as the same basic structure as the embodiment 710. The differences lie in the biasing means used to provide resistance to compression created by the muscles of the pelvic floor 42 and 44, when the device 810 is inserted within a pelvic body cavity. In this preferred embodiment, the gripper 818 is formed of compressible material, such as a rigid synthetic resin which flexes the legs 886 toward one another. As seen in FIG. 55, the gripper 818 is formed with a loop 802 in the mid portion of the gripper 818, which acts like a coil spring, biasing the legs 886 away from one another. FIG. 56 and FIG. 59 illustrate the use of an additional biasing means, a spring 892 which biases the legs 886 away from one another. FIG. 58 illustrates the use of resistance bodies 894, which were completely described in embodiment 710 and embodiment 510. The resistance bodies 894 help vary the resistance of the device 810 to the compression forces applied by the user, enabling use at different stages in the user's exercise program.

The exercise device 10 and its embodiments illustrated in devices 110–910, are sized and configured to be received within the vaginal and anal cavities of the human body to exercise the pelvic floor muscles. The length of the shaft 16 in each embodiment, is sized and configured so that it extends the length of the vaginal pelvic floor muscle platform 48 or the anal pelvic floor muscle platform 54.

In a preferred embodiment, for the average female adult, the shaft length is generally 2 ½ inches in length from the first end 26 to the second end 28 of the rigid element 24. In this preferred embodiment, the circumference of the shaft 16 in the uncompressed state is generally 4 inches. Obviously, the structure of the human body varies (from infant to adult and from adult to adult) such that the exercise device 10 may be manufactured in different sizes with different dimensions to ensure a comfortable fit for the user, the sizes provided being typical of one preferred embodiment only. Those skilled in the art will be able to make the necessary size adjustments for different situations. Also, as previously discussed, the resistance of the device 10 to compression may be adjusted by using less compressible material, by constructing the members from thicker material, by using resistance members or springs.

Having thus set forth a preferred construction for the current invention, it is to be remembered that this is but the preferred embodiment. Attention is now invited to a description of the use of the exercise device 10. The exercise device 10 is used to strengthen the muscles of the pelvis, particularly the collective group of muscles involved in human sexual response, which are also important for controlling the evacuation of the intestines and the bladder. The exercise device 10 focuses on increasing the muscle strength, tone, and endurance of these muscles by providing progressive resistance. Active exercisers that use the squeeze, hold, release and repeat technique against resistance, cause the muscles to do work, which is what produces the increase in muscle strength, tone, and endurance.

The particular group of muscles that control evacuation of the bladder, evacuation of the bowel and sexual response are the genital and anal muscles that include fibers from several groups of the pelvic muscles, which contract together around the bladder, urethra, rectum, and around the lower third of the vagina in women. These muscles include the pubococcygeus muscle, the iliococcygeus muscle, the deep transverse and superficial transverse perineal muscles, bulbocavernosus muscle and the Ischiocavernosus muscle. Many of the muscle fibers are interlaced, particularly around the rectum and the vagina so that exercising the muscles related to both the anal cavity and the vagina provide improvement in sexual response and general health of the pelvic area.

Figure 18:
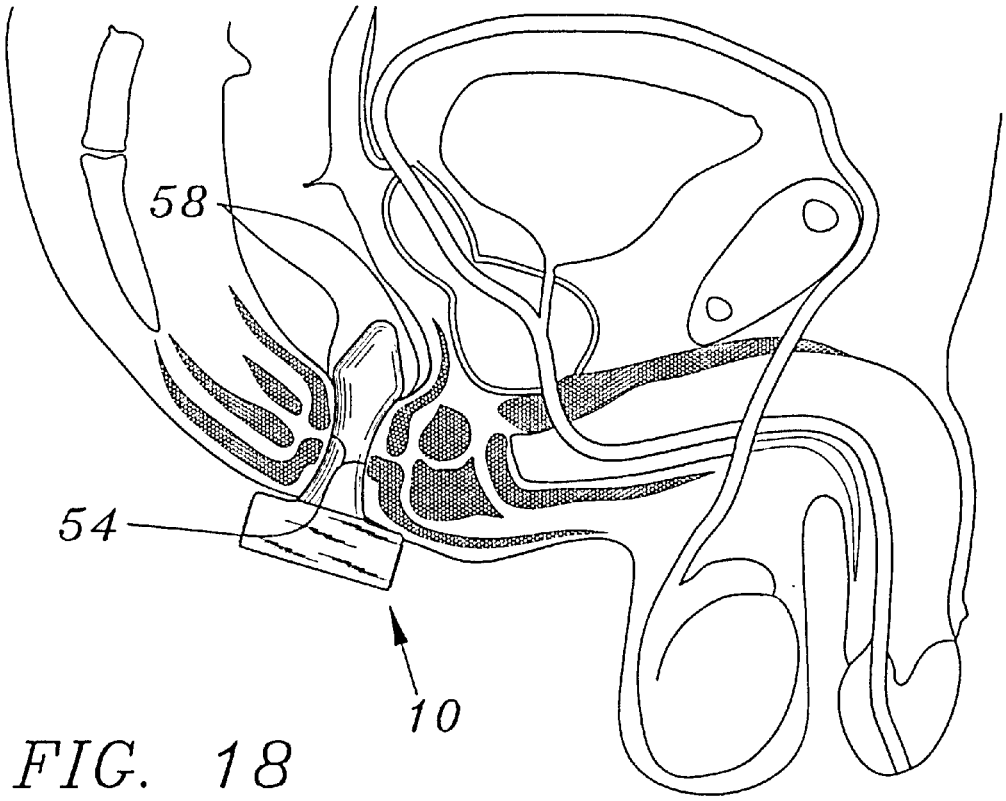
FIG. 18 is the line drawing of FIG. 17 illustrating the exerciser with the muscles of the pelvic floor contracted.
Figure 19:
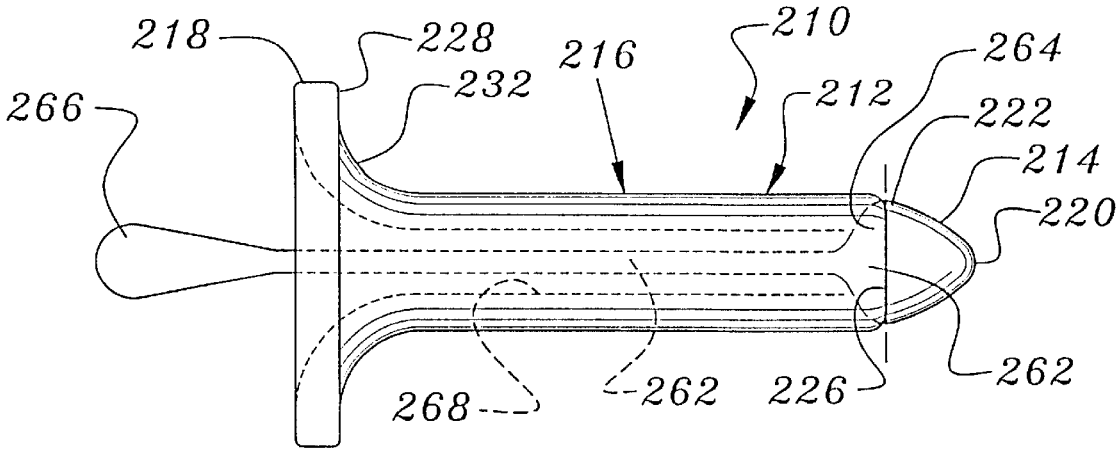
FIG. 19 is a front elevational view of a third embodiment of the invention.

To use the device the patient should lie down in a comfortable position with their knees up. If the device 10 is being inserted into the vagina, ensure that the vulva and the device 10 are lubricated with a water-soluble lubricant. If the device 10 is being inserted into the anal cavity, ensure that the anus and the device 10 are lubricated. For anal exercise a kneeling position may also be used. Grasp the gripper 24 between the fingers and thumb of one hand and insert into the pelvic body cavity until the retaining slope 30 of the device is cephalic and in juxtaposition to the retaining edge of the pelvic floor muscle platform. The muscle groups are shown generally as 44 in FIG. 13 for a female, and for the male the muscle groups are shown generally as 42 in FIG. 14. FIG. 15 shows insertion in the vagina of a female while FIG. 17 shows insertion in the anal cavity of a male. FIGS. 15 and 17 show the device 10 inserted with the muscle groups relaxed and the device 10 only partially compressed. The retaining slope 30 of the device 10 will assist in preventing the device 10 from being expelled by increased abdominal pressure (so called Valsalva maneuver) due to unintentional recruitment of the rectus abdominous and other abdominal muscles, while the user is trying to isolate his/her contractions to the pelvic floor muscles alone. The device should be sized and configured so that the pelvic floor muscle contractions should largely be applied around the shaft 16 of the device 10. FIGS. 16 and 18 illustrate the muscles being contracted and the compressible material 34 of device 10 being fully compressed. The patient, by squeezing the same muscles that are used to stop a urine flow or a bowel movement, squeezes the device 10 for as long as it is comfortable and then relaxes completely. There should be a full relaxation of the muscle groups between full contractions. This contraction and relaxation should be repeated about 21 times, comprising a set. If the patient is able, they should complete three sets with 15 seconds of relaxation between each set. When the patient is able to comfortably accomplish these repetitions the patient may increase the number of sets and/or move up to a firmer device which requires greater strength of the muscle groups to obtain full contraction.

Any muscle in the body will atrophy, weaken and get soft, thin and flabby without being used. The device 10, through the use of an exercise program similar to that described above, will strengthen these weakened muscles improving the patient's health and the patient's capability for sexual response.

It should be noted, as well, that the process of childbirth through vaginal delivery may result in the stretching and weakening of the pelvic floor muscles including bladder, vaginal, and related musculature. Whether muscle weakness is due to atrophy from lack of exercise, vaginal stretching during child birth, or both, the device 10 encourages (1) muscle reeducation by giving the tactile sensory feedback during exercise necessary to identify and isolate the pelvic floor muscles (since the device 10 is retained during exercise and offers something to be felt when squeeze against), (2) development of muscle tone, strength and endurance due to the work required of the muscles to contract against progressive resistance.

Weakened muscles may cause associated involuntary urinary leakage precipitated by sudden physical stress such as laughing, coughing, or sneezing. As an alternative to the surgical tightening of these muscles, the use of this invention to exercise and thus increase the tone, strength, and control of these muscles may reduce or eliminate these troubling symptoms and then obviate the necessity for surgery in cases of stress urinary incontinence.

Regular exercise with the device 10 may prevent or treat or reduce and minimize the symptoms from a variety of conditions which might otherwise result in costly or risky surgical procedures. These problems include: (1) the gaping of the vagina due to childbirth stretching, (2) uterine prolapse (dropped uterus), (3) cystocele (dropped bladder), (4) rectocele (dropped rectum), (5) pelvic relaxation syndrome (syndrome of pelvic discomfort, bladder dysfunction, low backache and sexual disturbances related to pelvic floor muscle weakness), (6) reduced penile/vulvo-vaginal contact and attendant potential sexual dysfunction and orgasmic dysfunction.

It will thus be seen that the objects set forth above, among those made apparent from the proceeding description, are efficiently attained and, since certain changes may be made in the above article without departing from the scope of the invention, it is intended that all matter contained in the above description or shown in the coming drawings shall be interpreted as illustrative and not to limiting sense.

It is also to be understood that the following claims are intended to cover all of the generic and specific features of the invention herein described, and all statements of the scope of the invention which, as a matter of language, might be said the fall therebetween.

Now that the invention has been described,

What is claimed is:

1. An exercise device receivable within a pelvic body cavity for exercising muscles of the pelvic floor, comprising:

a gripper;

a member comprising;

a shaft having at least two arms, each arm having a first end and a second end, said second end of each arm being attached to said gripper such that said at least two arms extend outwardly from said gripper, said arms being compressible toward one another, said first end of each arm having an outwardly extending retaining slope formed thereon, said retaining slope being engageable with the retaining edge of the adjacent pelvic floor muscle platform when said member is inserted within a pelvic body cavity, said second end of said arms having an outwardly extending slope formed thereon, said slope being engageable with the tissue adjacent to the orifice into the pelvic body cavity when said member is inserted into a pelvic body cavity, preventing over insertion of the member; and a head portion comprising two parts, each part having a first end and a second end, said second end of one of said two parts being attached to one of said at least two arms and the second end of the other one of said two parts being attached to the other one of said at least two arms, when said arms are compressed, said first end of said first part and said first end of said second part are adjacent one another, said head portion formed thereby tapers from said second end to said first end.

2. An exercise device as in claim 1, wherein said gripper comprises a U-shaped base having a first end and a second end, said second end of one of said legs being attached to said first end of said base and said second end of the other one of said legs being attached to said second end of said base, and said device further comprising a first resistance body inserted between said second end of one said arm and said base, and a second resistance body inserted between said second end of the other said arm and said base, whereby the resistance of said legs to compression is increased.

3. An exercise device as in claim 1, wherein said gripper further comprises means for biasing said arms apart from one another.

4. An exercise device as in claim 3, wherein said gripper comprises a U-shaped base having a first end and a second end, said second end of one of said legs being attached to said first end of said base and said second end of the other one of said legs being attached to said second end of said base, said biasing means comprising a flexible loop formed in said base, said loop being compressible such that when pressure is applied to said arms, said arms are moved toward one another and when said pressure is reduced said arms move away from one another.

5. An exercise device as in claim 4, further comprising a resistance body inserted between said second end of said arm and said base, whereby the resistance of said legs to compression is increased.

6. An exercise device as in claim 1, further comprising a biasing means inserted between said arms such that said arms are biased away from one another.

7. An exercise device as in claim 6 wherein said biasing means comprises a spring having a first end attached to one of said arms and a second end attached to the other one of said arms.

* * * * *